US009901502B2

(12) United States Patent
Rosario, Jr. et al.

(10) Patent No.: US 9,901,502 B2
(45) Date of Patent: Feb. 27, 2018

(54) COMBINATION MASSAGE TABLE WITH ONE OR MORE RESISTANCE BANDS

(71) Applicants: Edwin Rosario, Jr., Monrovia, CA (US); Sylvester Allison, III, Alhambra, CA (US)

(72) Inventors: Edwin Rosario, Jr., Monrovia, CA (US); Sylvester Allison, III, Alhambra, CA (US)

( * ) Notice: Subject to any disclaimer, the term of this patent is extended or adjusted under 35 U.S.C. 154(b) by 37 days.

(21) Appl. No.: 14/978,694

(22) Filed: Dec. 22, 2015

(65) Prior Publication Data

US 2017/0172832 A1 Jun. 22, 2017

(51) Int. Cl.

| | |
|---|---|
| ***A63B 21/04*** | (2006.01) |
| ***A61G 13/00*** | (2006.01) |
| ***A61H 37/00*** | (2006.01) |
| ***A63B 21/16*** | (2006.01) |
| ***A61G 13/12*** | (2006.01) |
| ***A63B 21/055*** | (2006.01) |
| ***A63B 23/035*** | (2006.01) |

(Continued)

(52) U.S. Cl.

CPC ..... *A61G 13/009* (2013.01); *A61G 13/121* (2013.01); *A61G 13/125* (2013.01); *A61H 37/00* (2013.01); *A63B 21/0442* (2013.01); *A63B 21/0552* (2013.01); *A63B 21/1672* (2015.10); *A63B 21/4013* (2015.10); *A63B 21/4021* (2015.10); *A63B 21/4034* (2015.10); *A63B 21/4035* (2015.10); *A63B 23/03541* (2013.01); *A61H 2201/0161* (2013.01); *A61H 2201/0192* (2013.01); *A61H 2201/1253* (2013.01); *A61H 2201/1261* (2013.01); *A61H 2201/164* (2013.01); *A61H 2201/1635* (2013.01); *A63B 21/0555* (2013.01); *A63B 2071/0694* (2013.01); *A63B 2210/50* (2013.01); *A63B 2225/093* (2013.01)

(58) Field of Classification Search

CPC .. A61G 13/009; A61G 13/121; A61G 13/125; A63B 21/1672; A63B 21/0557; A61H 37/00

USPC ..... 482/130

See application file for complete search history.

(56) References Cited

U.S. PATENT DOCUMENTS 1,075,309 A * 10/1913 Sullivan ..... A63B 21/0552 482/130

2,682,402 A * 6/1954 McCarthy ..... A63B 17/00 482/121

(Continued)

*Primary Examiner* — Andrew S Lo

(74) *Attorney, Agent, or Firm* — Eric Kelly

(57) ABSTRACT

A combination massage table with one or more resistance bands ("combination table") is disclosed. This combination table may include: a massage table; the one or more resistance bands; and a means for attaching the one or more resistance bands to the massage table; such that a client using the combination table receives at least one improved health benefit as compared against massage therapy without any resistance band use. Methods for using the combination table are also disclosed. Such methods may include: preparing the combination table for use; preparing the client so the client is laying on top of the combination table; and massaging the client while the client at least intermittently engages the one or more resistance bands that are attached to the combination table; wherein this results in the at least one improved health benefit to the client.

16 Claims, 21 Drawing Sheets

(51) Int. Cl.
*A63B 21/00* (2006.01)
*A63B 71/06* (2006.01)

(56) References Cited

U.S. PATENT DOCUMENTS 3,741,538 A * 6/1973 Lewis ..... A63B 17/00 482/120
4,136,868 A * 1/1979 Hogue ..... A63B 21/00047 482/145
4,198,044 A * 4/1980 Holappa ..... A63B 21/04 482/130
4,519,605 A * 5/1985 Leland ..... A63B 21/023 482/130
4,833,998 A * 5/1989 Everett ..... A47B 3/00 108/132
4,943,041 A * 7/1990 Romein ..... A47B 3/083 108/36
5,066,005 A * 11/1991 Luecke ..... A63B 21/0552 482/130
5,335,676 A * 8/1994 O'Brien ..... A47B 3/087 108/128
5,427,436 A * 6/1995 Lloyd ..... A47C 7/38 297/408
5,946,749 A * 9/1999 Sewell ..... A47C 1/143 297/188.08
6,081,947 A * 7/2000 Disher ..... A47C 20/026 248/118.3
6,245,001 B1 * 6/2001 Siaperas ..... A63B 21/04 482/123
6,408,465 B1 * 6/2002 Fleming ..... A47B 23/04 5/620
6,558,301 B1 * 5/2003 Jackson ..... A63B 21/0552 482/121
6,634,998 B2 * 10/2003 Siaperas ..... A63B 21/04 482/123
6,684,426 B1 * 2/2004 Lin ..... A47B 3/087 108/132
7,524,273 B1 * 4/2009 Martin ..... A63B 21/0552 482/121
7,591,763 B1 * 9/2009 Fucci ..... A63B 21/0552 482/121
7,601,101 B2 * 10/2009 Jackson ..... A63B 21/04 482/142
7,610,863 B1 * 11/2009 Smith-Huebner ..... A47B 3/091 108/36
7,694,370 B1 * 4/2010 Lee ..... A61G 13/009 5/622
7,785,242 B2 * 8/2010 Solomon ..... A61H 1/0229 482/121
7,862,489 B2 * 1/2011 Savsek ..... A63B 21/0455 482/121
8,029,425 B2 * 10/2011 Bronston ..... A63B 21/02 482/123
8,499,386 B2 * 8/2013 Roleder ..... A61H 7/001 5/620
8,555,437 B2 * 10/2013 Gorovitz ..... A61G 13/009 5/613
9,022,911 B2 * 5/2015 Goldberg ..... A63B 21/04 482/123
9,119,474 B2 * 9/2015 Husslage ..... A47C 13/00
9,295,602 B2 * 3/2016 Savich ..... A61G 13/009
D767,767 S * 9/2016 Moerth-Cross ..... D24/183
2005/0164856 A1 * 7/2005 Parmater ..... A63B 21/0552 482/142
2005/0197238 A1 * 9/2005 Parker ..... A63B 21/4029 482/142
2006/0252616 A1 * 11/2006 Gerschefske ..... A63B 5/00 482/142
2007/0087920 A1 * 4/2007 Dachraoui ..... A63B 21/0552 482/123
2007/0270292 A1 * 11/2007 Laney ..... A63B 21/4047 482/121
2009/0215594 A1 * 8/2009 Panaiotov ..... A63B 21/0552 482/130
2010/0151995 A1 * 6/2010 Forman ..... A63B 21/00047 482/8
2010/0299835 A1 * 12/2010 Andrews ..... A61G 13/009 5/620
2010/0323857 A1 * 12/2010 D'Silva ..... A63B 21/055 482/121
2011/0218081 A1 * 9/2011 Uygan ..... A63B 21/00185 482/92
2012/0083394 A1 * 4/2012 Gregor ..... A63B 21/00065 482/121
2012/0108401 A1 * 5/2012 Uygan ..... A63B 21/154 482/94
2012/0329619 A1 * 12/2012 Goldberg ..... A63B 21/04 482/129
2013/0074270 A1 * 3/2013 Caruso ..... A47C 21/00 5/658
2014/0121076 A1 * 5/2014 Lagree ..... A63B 21/0552 482/123
2014/0190371 A1 * 7/2014 Woog ..... A47B 3/0912 108/36
2014/0200125 A1 * 7/2014 Kabasso ..... A63B 21/00185 482/142
2015/0038304 A1 * 2/2015 Davenport ..... A63B 21/4035 482/123
2015/0072841 A1 * 3/2015 Lagree ..... A63B 21/152 482/139
2016/0059061 A1 * 3/2016 Lagree ..... A63B 21/00065 482/92
2016/0096062 A1 * 4/2016 Moerth-Cross ..... A61G 13/105 482/101
2016/0144217 A1 * 5/2016 Oltorik, Jr. ..... A63B 21/0442 482/130
2017/0065477 A1 * 3/2017 Jagger ..... A61H 1/0222

* cited by examiner

COMBINATION MASSAGE TABLE WITH ONE OR MORE RESISTANCE BANDS

TECHNICAL FIELD OF THE INVENTION

The present invention relates in general to massage tables and resistance bands and more specifically to a combination massage table with one or more resistance bands, as well as methods for using such a combination massage table with one or more resistance bands.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Presently (circa 2015), the inventors are not aware of any massage table combined with attached resistance bands. The inventors have discovered that by combining (e.g., by attaching) one or more resistance bands to a massage table, that during a given massage therapy session, wherein a client may also utilize the resistance bands, an improved (synergistic) health benefit may result, as compared to massage therapy utilizing only the massage table without any resistance bands.

There then is a need in the art for a combination massage table with one or more resistance bands; as well as method(s) for using such a combination massage table with one or more resistance bands.

It is to these ends that the present invention has been developed.

BRIEF SUMMARY OF THE INVENTION

To minimize the limitations in the prior art, and to minimize other limitations that will be apparent upon reading and understanding the present specification, the present invention describes a combination massage table with one or more resistance bands (hereinafter, a combination table). In some embodiments, such a combination table may comprise: a massage table; the one or more resistance bands; and a means for attaching the one or more resistance bands to the massage table; such that a client using the combination table may receive at least one improved health benefit as compared against massage therapy with no resistance band use. Furthermore, a method for using the combination table may be described and disclosed herein. Such a method may comprise steps of: preparing the combination table for use; preparing the client so the client is laying on top of an upper surface of the combination table; massaging the client while the client at least intermittently engages one or more resistance bands that are attached to the combination table; wherein the intermittent engagement of the one or more resistance bands while the client is being massaged may result in at least one improved health benefit to the client.

It is an objective of the present invention to provide a combination massage table with one or more resistance bands (hereinafter, a combination table) that may provide at least one improved health benefit to the client using the combination table as compared against a massage table without any attached resistance bands.

It is another objective of the present invention to provide the combination table where the one or more resistance bands may be engaged by the upper body and/or the lower body of the client.

It is another objective of the present invention to provide the combination table where the one or more resistance bands may be engaged by at least one hand or arm and/or at least one ankle or leg of the client.

It is another objective of the present invention to provide the combination table wherein there may be at least one or more resistance bands for each limb of the client.

It is another objective of the present invention to provide the combination table wherein there may be at least two or more resistance bands for at least one limb of the client; wherein the two or more resistance bands that may be paired for a particular limb may have different resistances and/or uses.

It is another objective of the present invention to provide the combination table wherein the one or more resistance bands may have different levels of resistances; such of these one or more resistance band may be color coded to visually indicate these different levels of resistances.

It is another objective of the present invention to provide the combination table wherein the combination table may be operated in at least two operational configurations, a deployed configuration and a folded configuration; wherein the deployed configuration may be for use and the folded configuration may be for transporting and/or storing the combination table.

It is yet another objective of the present invention that one or more resistance bands may be combined with a massage table in a fashion that does not interfere with a masseuse's ability to massage the client and/or with the masseuse's ability to access the client.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

In FIG. 4H, the band-guides may be openable-band-guides, which may be openable for ease of attaching or detaching the one or more resistance bands at the consistent location for use by the client.

REFERENCE NUMERAL SCHEDULE

Figure 1A:
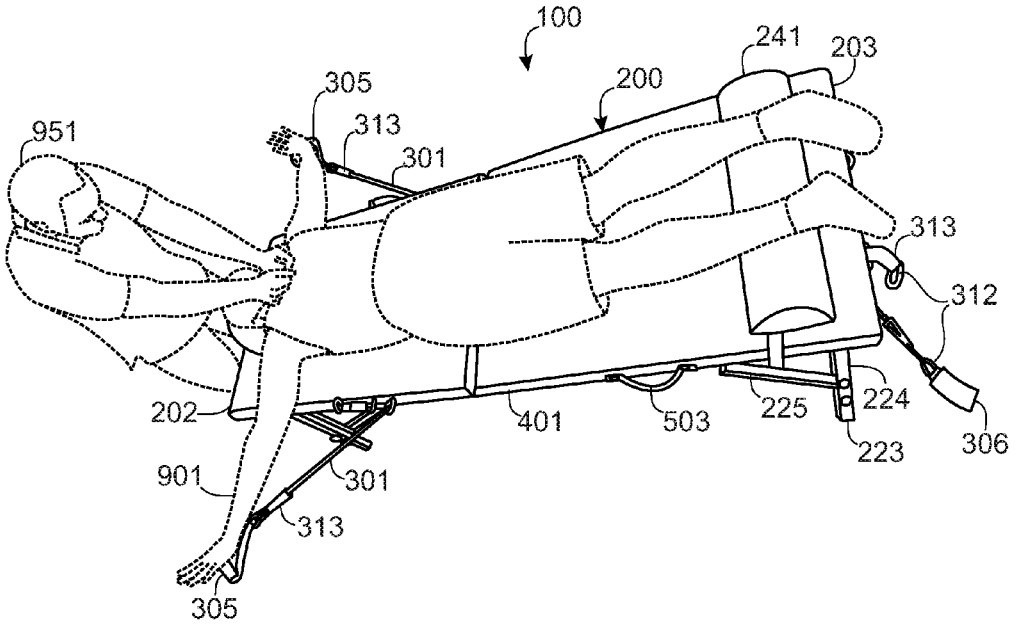
FIG. 1A may depict a combination massage table with one or more resistance bands (hereinafter the combination table) that may be in use with a client and a masseuse, wherein at least some portion of the client's body (e.g., an upper body portion) may be receiving a health benefit, shown from a top perspective view.

100 combination massage table with one or more resistance bands 100 (i.e., combination table 100)
200 massage table 200
201 tabletop 201
202 head end 202
203 foot end 203
204 upper surface 204
205 covering 205
207 lower surface 207
211 face-portal 211
212 perimeter 212
213 at least one head-cushion attachment region 213
214 head-cushion 214
221 elongate member 221
222 end 222
223 end 223
224 legs 224
225 at least one structural support 225
226 vertical height adjustment means 226
231 at least one display region 231
241 ankle support 241
251 storage strap 251
301 one or more resistance bands 301
302 engagement end 302
303 anchor end 303
305 handle 305
306 ankle strap 306
312 carabiner 312
313 coupling 313
401 rail 401
402 fixed distance 402
403 bottom surface 403
404 interior facing surface 404
405 exterior facing surface 405
411 anchor bracket 411
415 track 415
421 band-guide 421
425 openable-band-guide 425
431 mechanical fastener 431
501 first section 501
502 second section 502
503 handle 503
504 locking means 504
600 method of use 600
601 prepping combination table 601
603 placing combination table onto proper substrate 603
605 stability check for deployed combination stable 605
607 resistance band attachment and/or proper location check 607
609 prepping client 609
611 assist client onto combination table 611
613 assist client with engaging one or more engagement structures 613
615 massaging client and client resistance band engagement 615
621 receiving health benefit 621
901 client 901
951 masseuse 951

DETAILED DESCRIPTION OF THE INVENTION

A combination massage table with one or more resistance bands (hereinafter, a combination table) may be described and disclosed herein. In some embodiments, such a combination table may comprise: a massage table; the one or more resistance bands; and a means for attaching the one or more resistance bands to the massage table; such that a client using the combination table may receive at least one improved health benefit as compared against massage therapy without resistance band use. Furthermore, a method for using the combination table may be described and disclosed herein. Such a method may comprise steps of: preparing the combination table for use; preparing the client so the client is laying on top of an upper surface of the combination table; massaging the client while the client at least intermittently engages one or more resistance bands that are attached to the combination table; wherein in the at least intermittent engagement of the one or more resistance bands while the client is being massaged may result in the at least one improved health benefit to the client.

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention.

Figure 1B:
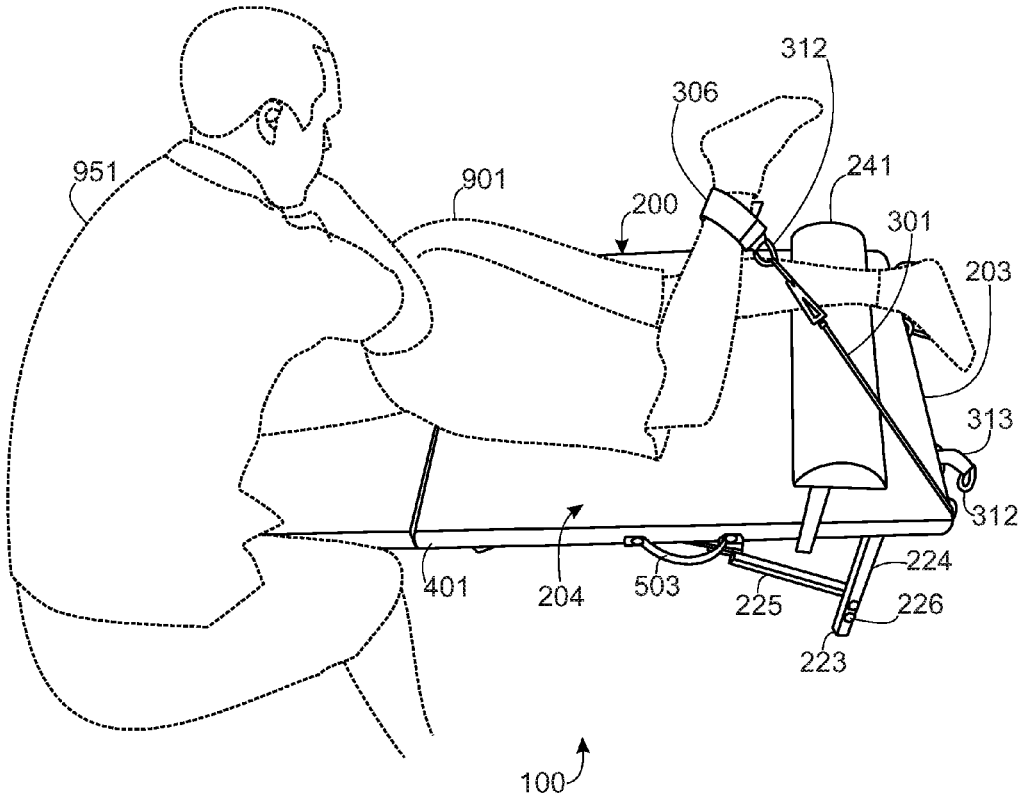
FIG. 1B may depict the combination table of FIG. 1A that may still be in use with the client and the masseuse; however, a lower body portion of the client's body may be receiving a health benefit, shown from a top perspective view. Note, the remaining views may not depict the client nor the masseuse.

A FIG. 1 series of figures may comprise FIG. 1A and FIG. 1B. These two figures may depict a combination massage table with one or more resistance bands 100 (hereinafter the combination table 100) that may be in use with a client 901 and a masseuse 951. FIG. 1A may depict combination table 100 where at least an upper portion of client 901's body may be receiving a health benefit, shown from a top perspective view. FIG. 1B may depict combination table 100 where at least a lower body portion of the client's 901 body may be receiving a health benefit, shown from a top perspective view. Note the remaining views may not depict client 901 or masseuse 951. Also note, the health benefit that client 901 may be receiving in FIG. 1A and in FIG. 1B may or may not be the same health benefit as between what may be depicted in these two figures.

In these FIG. 1 series of figures, masseuse 951 may be massaging client 901. Simultaneously, client 901 may be engaging one or more resistance bands 301. For example, and without limiting the scope of the present invention, in FIG. 1A, at least one of the client's 901 hands may be engaging a handle 305 that may be in communication with at least one resistance band 301; wherein that at least one resistance 301 may also be anchored to the massage table 200 of the combination table 100. That is, in some embodiments, combination table 100 may comprise massage table 200. For example, and without limiting the scope of the present invention, in FIG. 1B, at least one of client's 901 ankles may be engaged by an ankle strap 306 that may be in communication with at least one resistance band 301; wherein that at least one resistance 301 may also be anchored to the massage table 200 of the combination table 100.

Because of inherent resistance quality (e.g., arising from a given elasticity modulus of a given resistance band 301), when client 901 may be engaging a given resistance band, at least some muscles in client 901 may also be engaged, e.g., in a flexed state; while simultaneously, client 901 may be receiving various massage techniques from masseuse 951, either on the engaged (i.e., activated) muscle of the client 901 and/or in different related muscles of the client 901 or some combination of such muscles; wherein a synergistic health benefit may be received by client 901.

This health benefit for client 901 may be one or more of: an increase in relaxation; a decrease in stress; an increase in mobility; an increase in flexibility; a decrease in stiffness; a decrease in pain; improved blood flow and/or blood circulation; reduction of headache quantity; reduction of headache severity; improved rehabilitation; improved recovery and/or the like. Such health benefits may be synergistic when the massage techniques are combined with resistance band 301 use, in that these health benefits may be derived faster as compared to massage techniques without resistance band 301 use. Furthermore, another important synergistic health benefit may be an increase in client 901 compliance, because with resistance band 301 use combined with massage, client 901 may be interactive, more involved, engaged, and/or in control of their given massage session (as compared to massage alone with no resistance band use); and this improved client 901 compliance may further facilitate with obtaining faster health benefits (as compared to massage alone with no resistance band use). Additionally, as a collateral benefit, client 901 may simultaneously be exercising various muscles, resulting in calorie burning and/or muscle strengthening and/or toning.

In some embodiments, masseuse 951 may be providing instructions to client 901 and educating on how, when, where, and why client 901 may be engaging one or more resistance bands 301.

Figure 2A:
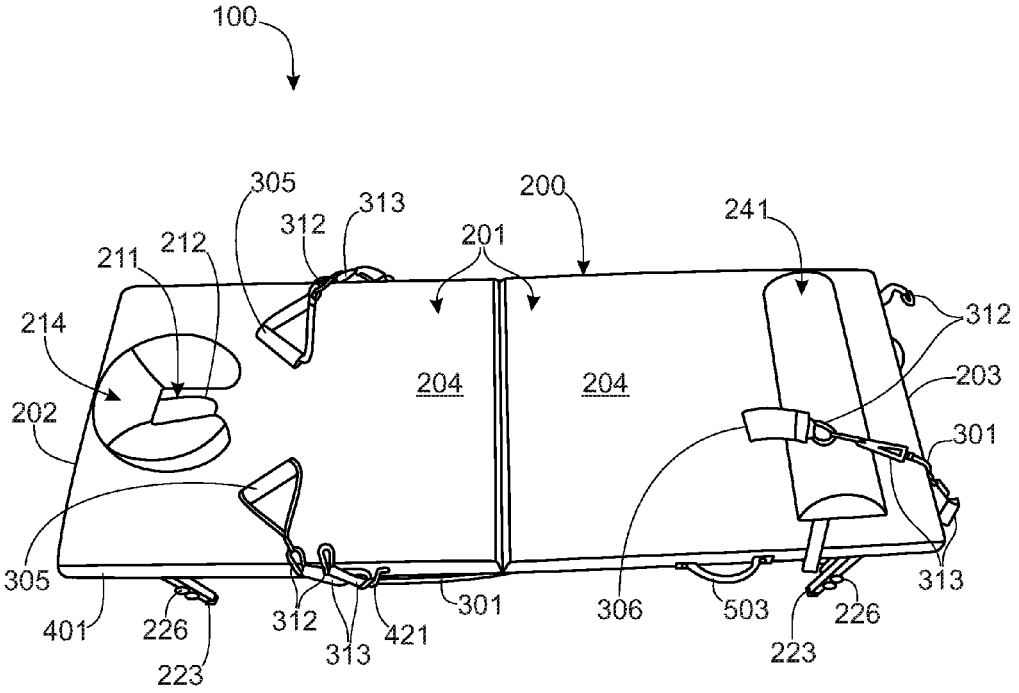
FIG. 2A may depict the combination table of FIG. 1A, shown from a top perspective view.
Figure 2B:
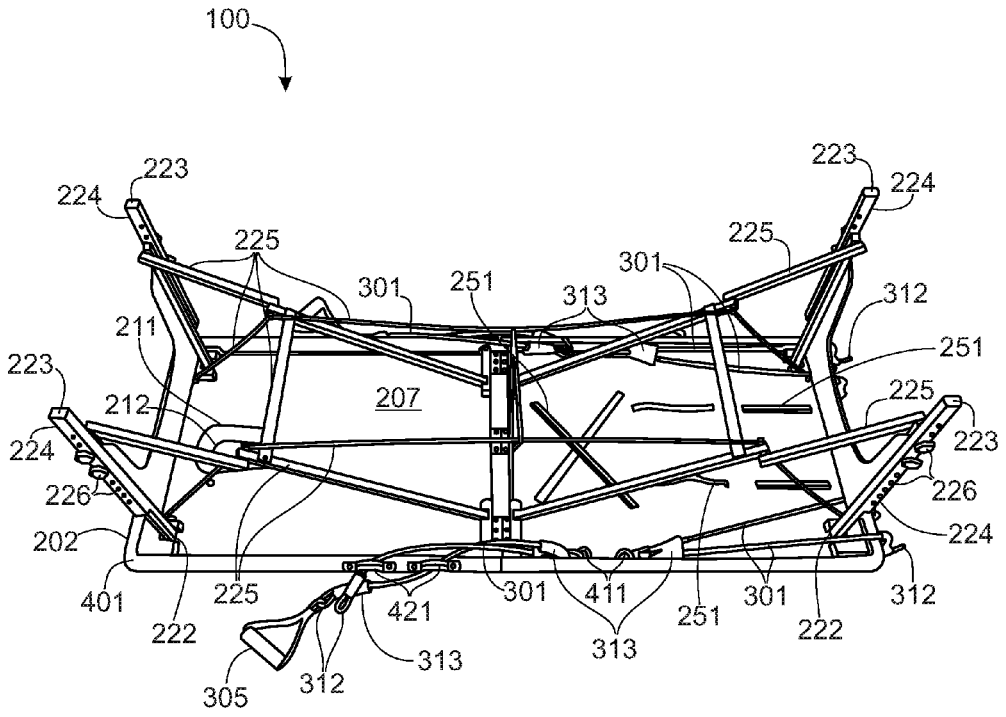
FIG. 2B may depict the combination table of FIG. 1A, shown from a bottom perspective view.
Figure 2C:
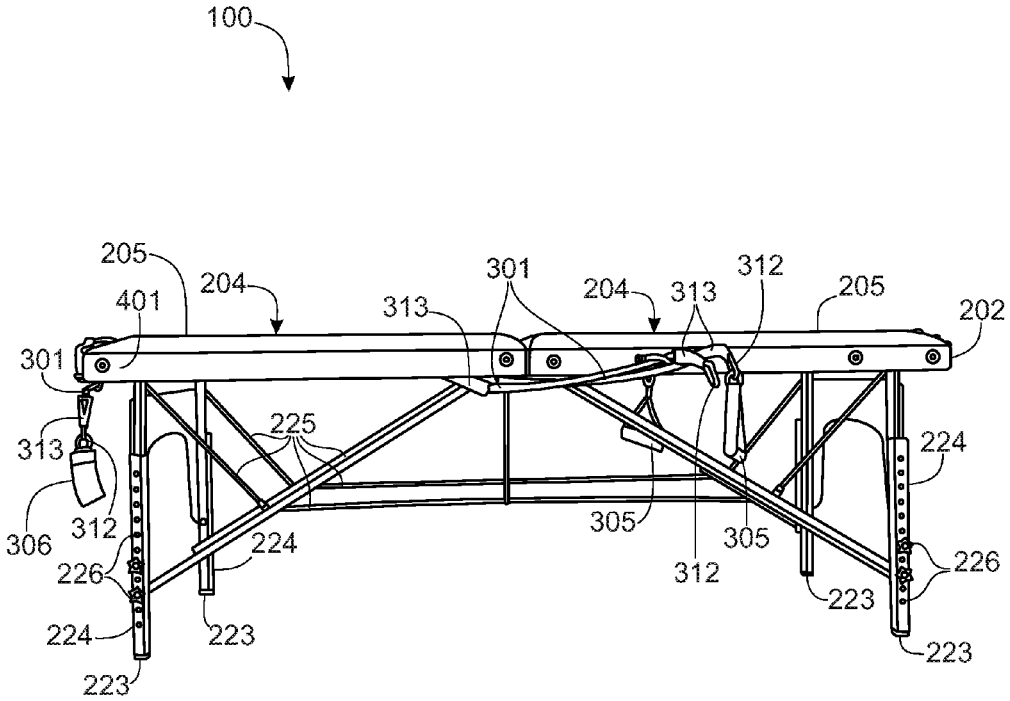
FIG. 2C may depict the combination table of FIG. 1A, shown from a longitudinal side view. Note left and right longitudinal sides views may be substantially the same.
Figure 2D:
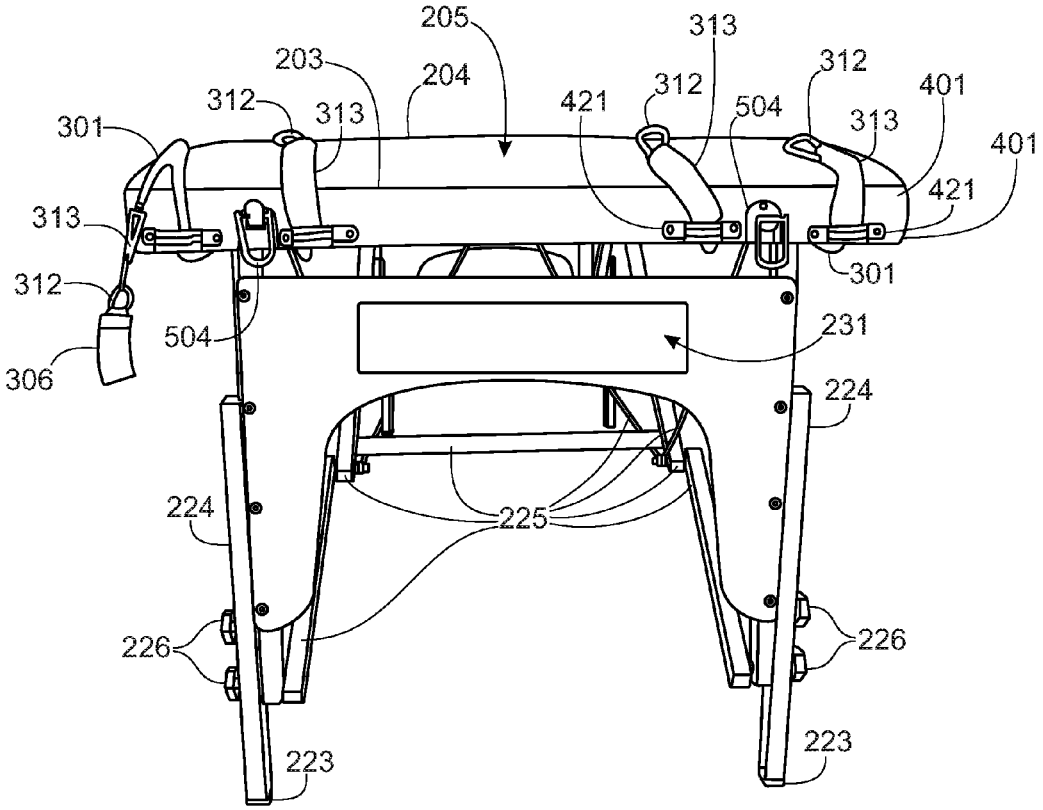
FIG. 2D may depict the combination table of FIG. 1A, shown from a transverse width end view of a foot end of the combination table.
Figure 2E:
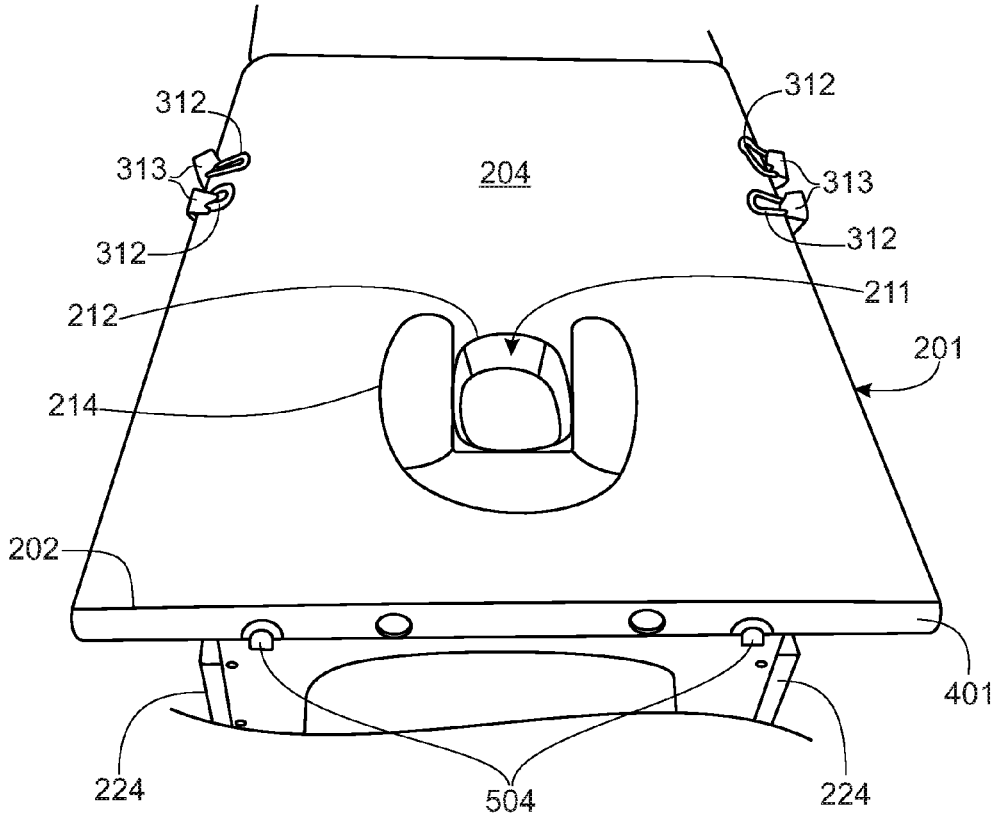
FIG. 2E may depict the combination table of FIG. 1A, shown from a top perspective transverse width end view of a head end of the combination table, that also may depict a head-cushion (which may be a face-cushion in some embodiments).
Figure 2F:
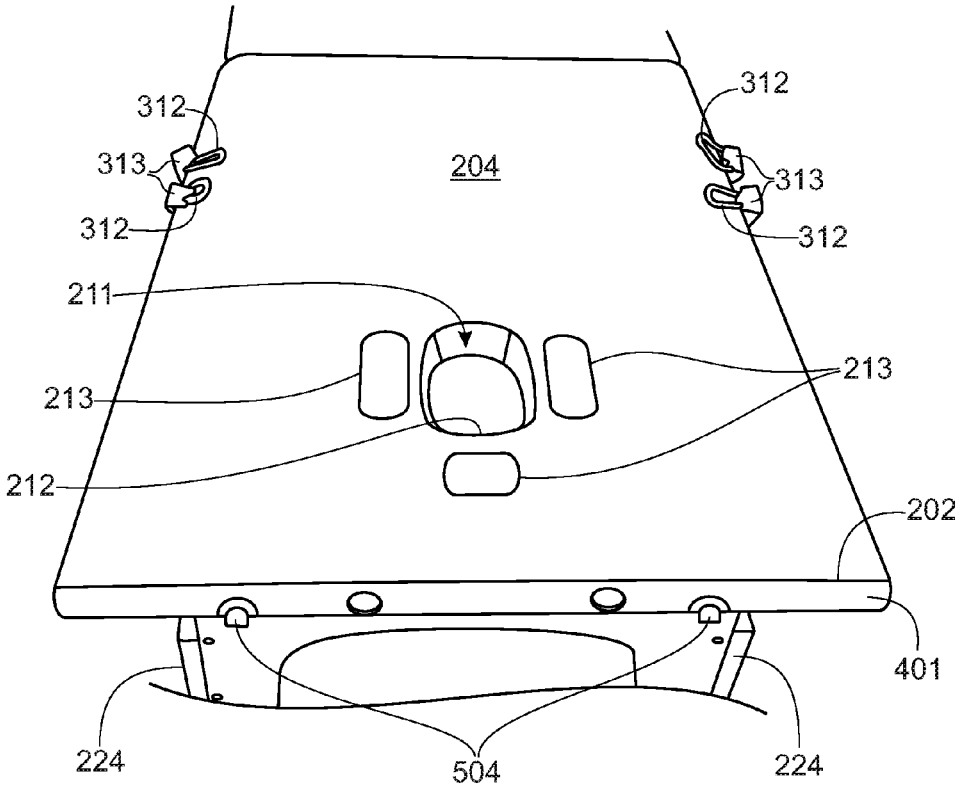
FIG. 2F may depict the combination table of FIG. 1A, shown from the top perspective transverse width end view of the head end of the combination table, but without depicting the head-cushion.

A FIG. 2 series of figures may comprise FIG. 2A through and including FIG. 2F. These FIG. 2 series of figures may focus on depicting various geometry and/or structures of massage table 200; wherein in some embodiments, combination table 100 may comprise massage table 200.

FIG. 2A may depict combination table 100, shown from a top perspective view. FIG. 2B may depict combination table 100, shown from a bottom perspective view. FIG. 2C may depict combination table 100, shown from a longitudinal side view. In some embodiments, left and right longitudinal sides views may be substantially the same. FIG. 2D may depict combination table 100, shown from a transverse width end view of a foot end 203 of combination table 100. FIG. 2E may depict combination table 100, shown from a top perspective transverse width end view of a head end 202 of combination table 100, that also may depict a head-cushion 214. In some embodiments, head-cushion 214 may be a face-cushion. FIG. 2F may depict combination table 100, shown from the top perspective transverse width end view of head end 202 of combination table 100, but without depicting head-cushion 214.

In some embodiments, combination table 100 may comprise: massage table 200, one or more resistance bands 301, and a means for attaching one or more resistance bands to massage table 200; wherein client 901 use of combination table 100 may receive at least one health benefit.

In some embodiments, massage table 200 may comprise: a tabletop 201 (see FIG. 2A) with an upper surface 204 (see FIG. 2A) and a lower surface 207 (see FIG. 2B) disposed opposite of upper surface 204. In some embodiments, upper surface 204 may physically support client 901. See FIG. 1A and/or FIG. 1B. In some embodiments, upper surface 204 may be in removable physical contact with portions of client 901 who may be lying on top of upper surface 204. See FIG. 1A and/or FIG. 1B. In some embodiments, tabletop 201 may comprise two opposing terminal ends, head end 202 and foot end 203. See FIG. 2A. In some embodiments, head end 202 and foot end 203 may indicate longitudinal boundaries of a given massage table 200 (or of a given combination table 100).

In some embodiments, one or more of: tabletop 201, upper surface 204, and/or lower surface 207 may be substantially planar members. In some embodiments, tabletop 201, upper surface 204, and lower surface 207 may each be a substantially planar member. See e.g., FIG. 2A and FIG. 2B.

In some embodiments, tabletop 201 may be comprised of at least one rigid to semi-rigid members. In some embodiments, tabletop 201 may interiorly constructed from the at least one rigid to the at least one semi-rigid members. In some embodiments, disposed between upper surface 204 and lower surface 207 may be one or more rigid to semi-rigid members (not depicted in the figures). In some embodiments, these rigid to semi-rigid members may provide structure that enables tabletop 201 to support client 901. In some embodiments, these rigid to semi-rigid members may be arranged as one or more sheets. For example, and without limiting the scope of the present invention, in some embodiments, such one or more sheets may be plywood and/or composite particle board; and/or some suitable laminate for the intended purpose of tabletop 201 supporting client 901. In some embodiments, these rigid to semi-rigid members may be arranged in a grid fashion where the rigid to semi-rigid members may be a plurality of elongate members.

In some embodiments, disposed to an interior side of the upper surface 204 may be at least one cushion. This at least one cushion may provide comfort and/or support to client 901, when client 901 is being supported by upper surface 204. In some embodiments, this at least one cushion may be substantially constructed from one or more foam members and/or from batting.

In some embodiments, upper surface 204 may be substantially covered with a covering 205. See e.g., FIG. 2C. Or alternatively, in some embodiments, covering 205 may replace upper surface 204 in the figures. Or alternatively, in some embodiments, upper surface 204 may be covering 205.

In some embodiments, such a given covering 205 may bound upper and peripheral sides of the at least one cushion. In some embodiments, covering 205 may be substantially constructed from any material of construction suitable as upholstery. In some embodiments, covering 205 may be substantially constructed from any material of construction suitable to cover furniture. In some embodiments, covering 205 may be substantially constructed from one or more textiles and/or fabrics. Such textiles and/or fabrics may be natural and/or synthetic.

In some embodiments, massage table 200 may comprise one or more rails 401. See e.g., any of the FIG. 2 figures. In some embodiments, one or more rails 401 may be attached to and/or integral to tabletop 201. One or more rails 401 may be discussed further in a FIG. 4 series of figures discussion below.

In some embodiments, a two dimensional projection of the tabletop 201 as viewed from a top direction may be a shape selected from a group consisting of: a rectangle, with or without rounded corners; a regular polygon, with or without rounded corners; an irregular polygon, with or without rounded corners; an oval; an ellipse; a circle; and/or the like. In some embodiments, rail 401 may bound (i.e., circumscribe) each edge of this shape. In some exemplary embodiments, this two dimensional projection of the tabletop 201 as viewed from the top direction may be the rectangle shape, with rounded corners. In some exemplary embodiments, tabletop 201 may be substantially a rectangular prism with rounded corners. See e.g., FIG. 2A and FIG. 2B.

In some embodiments, tabletop 201 may comprise a face-portal 211 that may be formed from a bound cutout within the tabletop 201 that runs from upper surface 204 to lower surface 207. See e.g., FIG. 2A and FIG. 2B. In some embodiments, face-portal 211 may be located closer to head end 202 than to foot end 203. In some embodiments, this face-portal 211 may be located in first section 501. In some embodiments, face-portal 211 may comprise an opening that may be sized to receive at least some portions of a face of the client 901. In some embodiments, face-portal 211 may serve at least a function of permitting client 901 to breathe normally while client 901 may be laying face down upon upper surface 204, without twisting a neck of client 901 into an uncomfortable position.

In some embodiments, face-portal 211 may have a two dimensional shape as viewed from a top direction. In some embodiments, this two dimensional shape may be selected from a group consisting of: a rectangle, with or without rounded corners; a regular polygon, with or without rounded corners; an irregular polygon, with or without rounded corners; an oval, an ellipse, and a circle. In some embodiments, this two dimensional shape may be the rectangle, with rounded corners.

In some embodiments, disposed around at least some portion of a perimeter 212 of face-portal 211 and within a proximate distance of some portion of perimeter 212, may be head-cushion 214. See e.g., FIG. 2E. In some embodiments, head-cushion 214 may be a raised cushioned structure that extends away from upper surface 204, when head-cushion 214 may be mounted to upper surface 204. In some embodiments, head-cushion 214 may provide for comfort and support to at least some portions of the head and/or of the face of client 901. In some embodiments, head-cushion 214 may be a face cushion. For example, and without limiting the scope of the present invention, in some embodiments this proximate distance between the some portion of perimeter 212 and head-cushion 214 may be from 0.01 inch to five inches. In some embodiments, head-cushion 214 may begin at perimeter 212.

In some embodiments, head-cushion 214 may be attached and/or removed from the tabletop 201. In some embodiments, disposed around at least some portion of perimeter 212 face-portal 211 and within the proximate distance from the some portion of perimeter 212 may be at least one head-cushion attachment region 213 on upper surface 204 that may be removably attaches to a bottom region of head-cushion 214. See e.g., FIG. 2F for at least one head-cushion attachment region 213. An attachment means between at least one head-cushion attachment region 213 and the bottom region of head-cushion 214 may by various mechanical fasteners; such as, but not limited to: a plurality of hooks and a plurality of complimentary loops (e.g., as in a VELCRO type attachments means), buttons, snaps, zippers, tie-downs, and/or the like.

In some embodiments, massage table 200 may comprise a vertical support means that when massage table 200 may be in a deployed configuration this vertical support means may maintain upper surface 204 at a substantially uniform distance along an entirety of tabletop 201 from a substrate, assuming that substrate is of a substantially level surface, with minimal slope (grade) for at least a longitudinal length of combination table 100. For example, and without limiting the scope of the present invention, this substrate may be a floor or a ground, with or without additional coverings, such as carpeting and/or rugs.

In some embodiments, this vertical support means may comprise at least two elongate members. In embodiments where there may be two elongate members, these two elongate members may be longitudinally disposed from each other. In some embodiments, the vertical support means may comprise two pairs of oppositely disposed legs 224 (i.e., such that there may be at least four legs 224 in total). In some embodiments, each elongate member may be a leg 224. In some embodiments, for each corner of the shape of the two dimensional projection of the tabletop 201 as viewed from a top direction there may be comprise attachment of one such elongate member (or leg 224). In some embodiments, there may be four separate elongate members (or legs 224), arranged in two opposing pairs. See e.g., FIG. 2B.

In some embodiments, one end, end 223, of each of these at least two elongate members (or legs 224) may physically contact the substrate and another oppositely disposed end, end 222, of each of these at least two elongate members (or legs 224) may be attached to tabletop 201, or some structure of tabletop 201. See e.g., FIG. 2B, FIG. 2C (for end 223), and FIG. 2D (for end 223). In some embodiments, each of the at least two elongate members (e.g., leg 224) may be attached to tabletop 201 at a location on lower surface 207 or to an intermediary structure (i.e., the some structure of tabletop 201) that may be attached to lower surface 207 (and/or attached to interior facing surface 404 of a given rail 401). See e.g., FIG. 2B (and see FIG. 3). Such points of attachment may be proximate to or at a closest corner of the shape of the two dimensional projection of tabletop 201 as viewed from a top direction. Such a proximate measurement may be within twelve inches of that closest corner. That is, in some embodiments, a given leg 224 may extend from tabletop 201, from within twelve inches of at least one corner.

In some embodiments, a height of the vertical support means may be adjustable. This may permit a height of upper surface 204 with respect to the substrate to be varied. In some embodiments, each of these at least two elongate members may comprise a vertical height adjustment means 226. See e.g., FIG. 2B, FIG. 2C, and FIG. 2D. For example, and without limiting the scope of the present invention, vertical height adjustment means 226 may comprise a system of adjustable and locking telescoping legs 224 or a system of adjustable and locking slidingly translational legs 224; where in either embodiment each leg 224 comprises a pair of sub-legs 224 that may slidingly translate with respect to each other. Along a length of such sub-legs 224 there may be plurality of set holes for lockingly varying the height of upper surface 204.

In some embodiments, where each of the at least two elongate members (e.g., leg 224) may be attached to tabletop 201, this attachment may be able to pivot between each of the at least two elongate members (e.g., legs 224) and tabletop 201; such that when table 100 may be in the folded configuration each of the at least two elongate members (e.g., legs 224) may be folded and disposed within first section 501 and second section 502. See FIG. 5 series of figures for depictions of the folded configuration.

Continuing discussing the FIG. 2 series of figures, in some embodiments, the vertical support means may comprise at least one structural support 225 that may provide one or more of side to side and/or front to back stability for combination table 100 or to massage table 200. In some embodiments, each of the at least one structural support 225 may be attached to one or more of: at least one of the two elongate members (e.g., legs 224), another of the at least one structural support 225, lower surface 207, or an interior facing surface 404 of a rail 401. Some at least one structural support 225 may be a rigid to semi-rigid member. Some at least one structural support 225, between its at least two points of attachment, may provide at least some tension. Some at least one structural support 225 may act as a truss. Some at least one structural support 225 may be tension cables. See e.g., FIG. 2B, FIG. 2C, and FIG. 2D.

In some embodiments, combination table 100 and/or massage table 200 may comprise at least one display region 231. In some embodiments, at least one display region 231 may display one or more of: a logo, a graphic, artwork, a brand, a trademark, a tradename, a photograph, instructions, writing, and/or some combination thereof. In some embodiments, at least one display regions 231 may be located on one or more of: upper surface 204, lower surface 207, an exterior facing surface 405 of a given rail 401 of tabletop 201, and/or a region of an elongate member of a vertical support means. See e.g., FIG. 2D.

Figure 3:
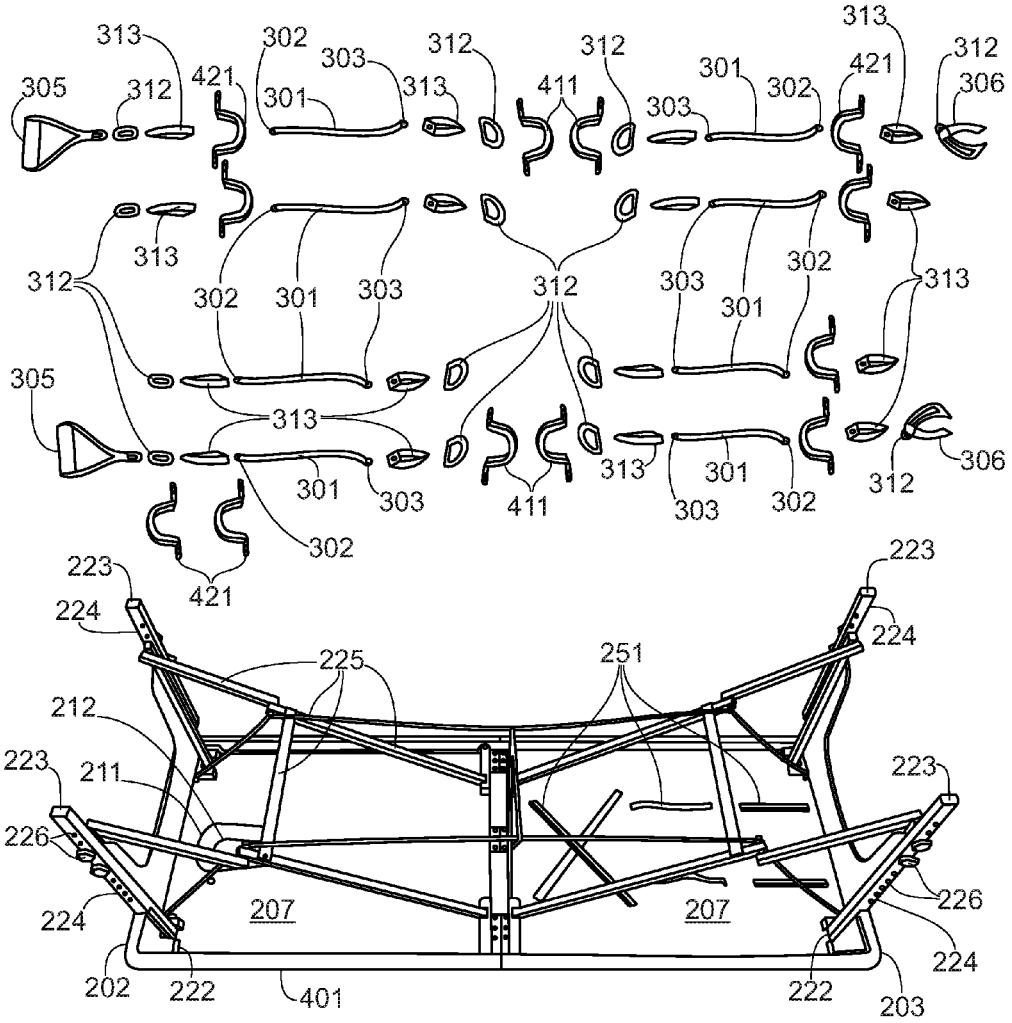
FIG. 3 may depict the combination table of FIG. 1A, shown as a partial exploded view, from a bottom perspective, showing the one or more resistance bands, engagement structures, and means for attaching exploded away from an underside of a massage table.

FIG. 3 may depict the combination table 100, shown as a partial exploded view, from a bottom perspective, showing the one or more resistance bands 301, engagement structures, and means for attaching exploded away from an underside (such as lower surface 207) of massage table 200.

In some embodiments, each of one or more resistance bands 301 may be an elastic elongate member. In some embodiments, each of one or more resistance bands 301 may be an elastic and flexible elongate member. In some embodiments, such members may be at least partially sheathed to protect the given member. In some embodiments, such members may be of a woven construction from a plurality of fibers or a plurality of single elastic elements. In some embodiments, such members may be of a non-woven construction, i.e. of a single integral member for a given resistance band 301. In some embodiments, each of one or more resistance bands 301 may be substantially constructed of one or more elastomeric materials. In some embodiments, each of one or more resistance bands 301 may be substantially constructed of one or more of: a natural rubber, a synthetic rubber, a latex rubber, a latex-free rubber, a silicone, and/or the like.

In some embodiments, each of one or more resistance bands 301 may comprise two oppositely disposed terminal ends, an engagement end 302 and an anchor end 303. See FIG. 3. In some embodiments, anchor end 303 may be attached to massage table 200 via the means for attaching. In some embodiments, engagement end 302 may be attached to an engagement structure. In some embodiments, at least some portion of the engagement structure may be for the client 901 to engage.

In some embodiments, structurally, engagement end 302 and anchor end 303 may be substantially identical. In some embodiments, engagement end 302 and/or anchor end 303 may comprise a knot. In some embodiments, engagement end 302 and/or anchor end 303 may comprise enlarged structure that is larger than a diameter of one or more resistance bands 301 in a middle region of one or more resistance bands 301. In some embodiments, engagement end 302 and/or anchor end 303 may comprise the enlarged structure that may be larger than the thickness of one or more resistance bands 301 in the middle region of one or more resistance bands 301. This knot and/or this enlarged structured may be trapped and/or captured by other structures, such as, but not limited to, a coupling 313. This knot and/or this enlarged structured may be attached to other structures, such as, but not limited to, coupling 313.

In some embodiments, the engagement structure may be selected from a group comprising of one or more of: handle 305, a handhold, ankle strap 306, a wrist strap, and/or various attachment hardware. The various attachment hardware may comprise of one or more of: a swivel, a link, a ring, a D-ring, coupling 313, a carabiner 312, and/or the like. In some embodiments, the engagement structure may be selected from a group comprising of one or more of: handle 305, the handhold, ankle strap 306, the wrist strap, the swivel, the link, the ring, the D-ring, coupling 313, and carabiner 312. In some embodiments, links, rings, D-rings, and carabiners 312 may be interchangeable.

In some embodiments, such handles 305 and/or handholds may be substantially covered with a foam and/or elastomeric material providing comfort to client 901. In some embodiments, ankle straps 306 and/or the wrist straps may removably circumscribe an ankle and/or a wrist of client 901, respectively. In some embodiments, ankle straps 306 and/or the wrist straps may be removably sealed with a plurality of hooks and a plurality of complimentary loops (e.g., as in a VELCRO type closure means). In some embodiments, handles 305, handholds, ankle straps 306, and/or wrist straps may comprise at least one: link, ring, D-ring, or carabiner 312.

In some embodiments, coupling 313 may attach to either engagement end 302 or to anchor end 303. In some embodiments, coupling 313 may comprise a major loop of webbing (strapping), wherein disposed within that major loop may be a hole sized to receive the thickness of one or more resistance bands 301 in the middle region, but small enough not to permit passage of the knot and/or the enlarged structure of engagement end 302 and anchor end 303. In this way a given coupling 313 may attach to a given resistance band 301 via the hole within the major loop and the major loop itself of any given coupling 313 may then attach to one or more of: links, rings, D-rings, and carabiners 312, anchor brackets 411, and/or band-guides 421. In some embodiments, coupling 313 may be integral with the anchor end 303.

In some embodiments, a quantity of one or more resistance bands 301 must be evenly dividable by four, such that there may be at least one resistance band 301 for each limb of client 901. In some embodiments, where there may be two or more resistance bands 301 arranged for a given limb of client 901, such paired resistance bands 301 may comprise different resistances. In some embodiments, one or more resistance bands 301 may comprise from one resistance band 301 up to and including twenty distinct resistance bands 301. In an exemplary embodiment, one or more resistance bands 301 may comprise from eight total resistance bands 301.

In some embodiments, one or more resistance bands 301 may comprise at least four resistance bands 301 arranged as follows, with at least one resistance band accessible by each arm and each leg of client 901 who will be laying on the tabletop 201 of massage table 200. In an exemplary embodiment, there may be eight resistance bands 301, with four of those eight resistance bands 301 for upper body use on client 901, with two per side of client 901; and the remaining four of the eight resistance bands 301 for lower body use of client 901, with two per side of client 901. See FIG. 3. In some embodiments, each pair of resistance bands 301 for a given limb may be of different resistances.

In some embodiments, one or more resistance bands 301 may be color coded. For example, and without limiting the scope of the present invention, different colors, may represent different resistances. For example, and without limiting the scope of the present invention, different colors, may represent one or more resistance bands 301 for client 901 upper body use or for client 901 lower body use.

Figure 4A:
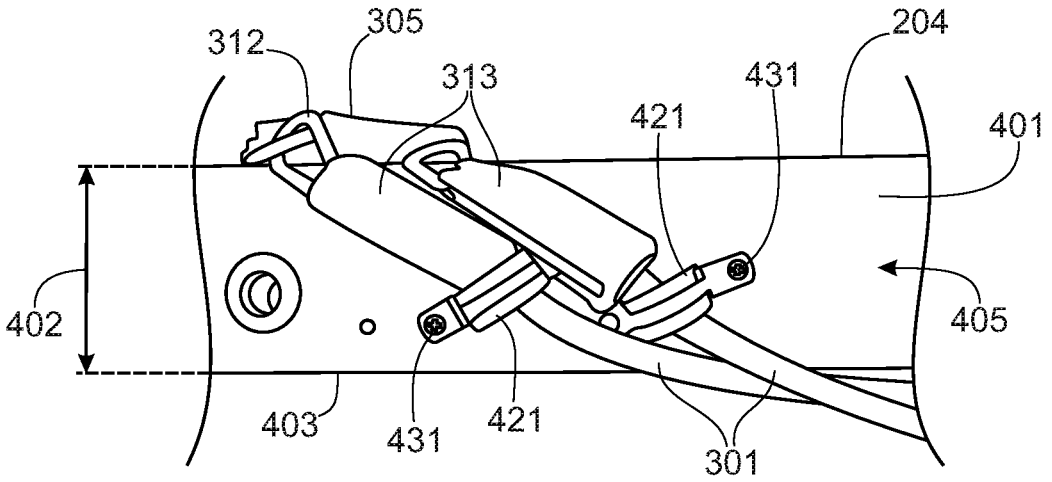
FIG. 4A may depict a partial longitudinal side view of an exterior facing surface of a rail of the massage table showing band-guides mounted to this rail to guide and provide the one or more resistance bands at a consistent location for use by the client.
Figure 4B:
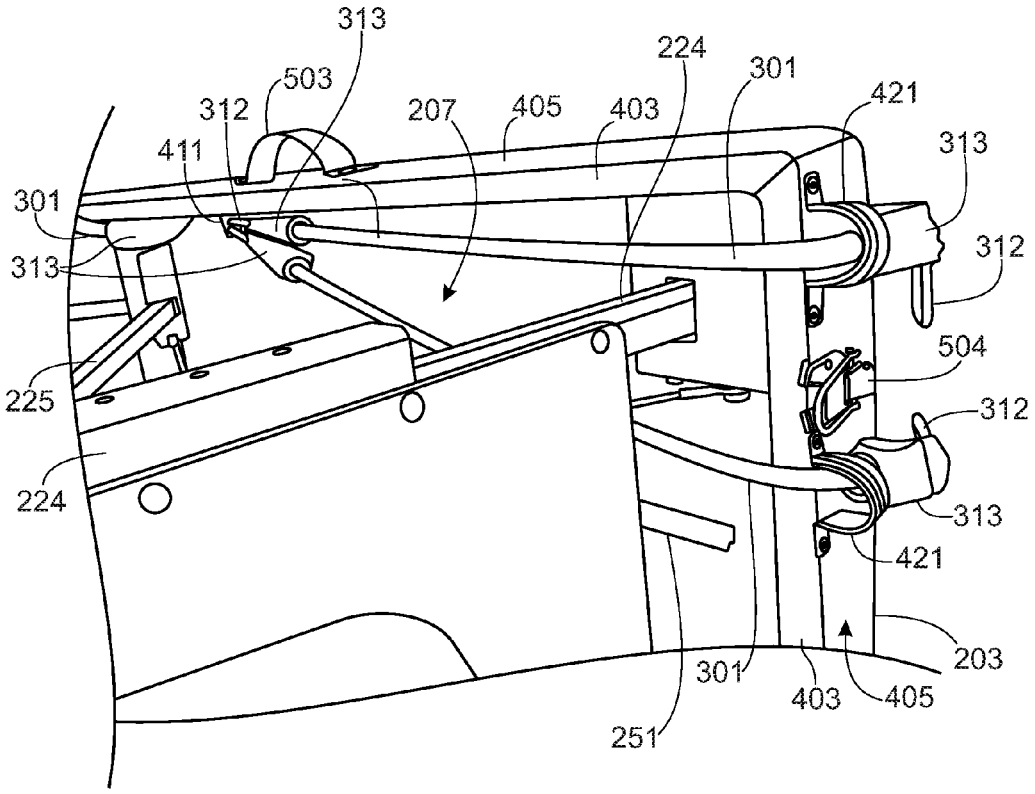
FIG. 4B may depict a partial underside perspective view of one bottom corner at the foot end of the combination table of FIG. 1A, shown from a bottom perspective view.
Figure 4C:
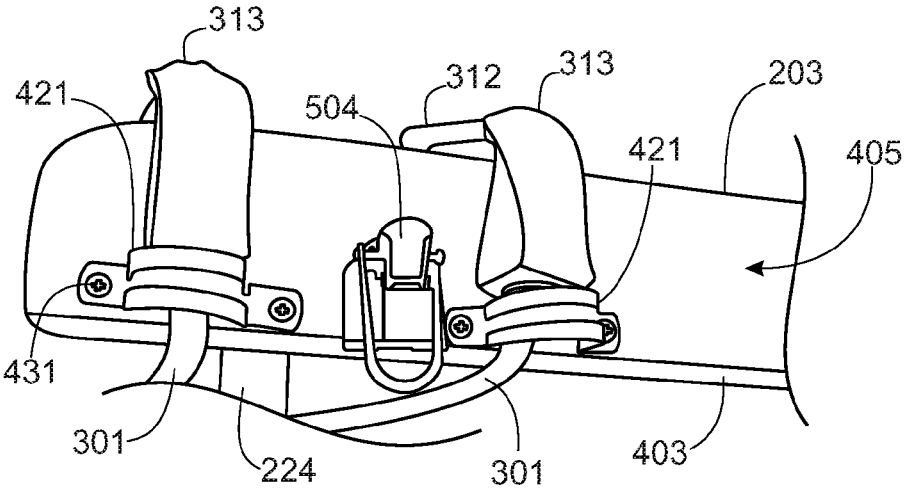
FIG. 4C may depict a partial view of one corner at the foot end of the combination table of FIG. 1A, shown from a transverse width end view.
Figure 4D:
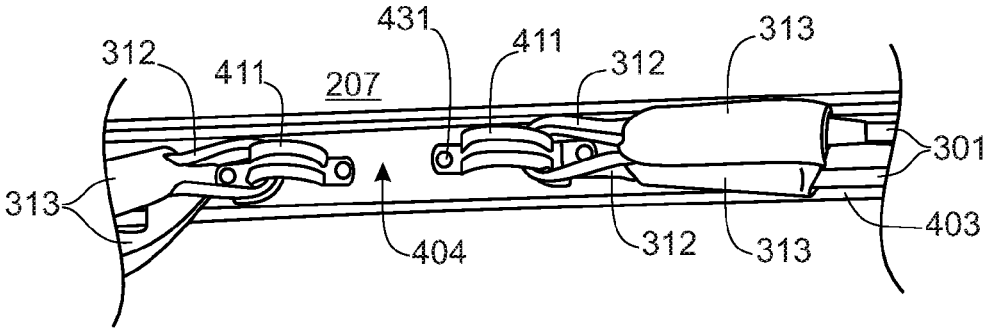
FIG. 4D may depict a partial view of an interior facing surface of a rail of the combination table of FIG. 1A, shown from a bottom perspective view.
Figure 4E:
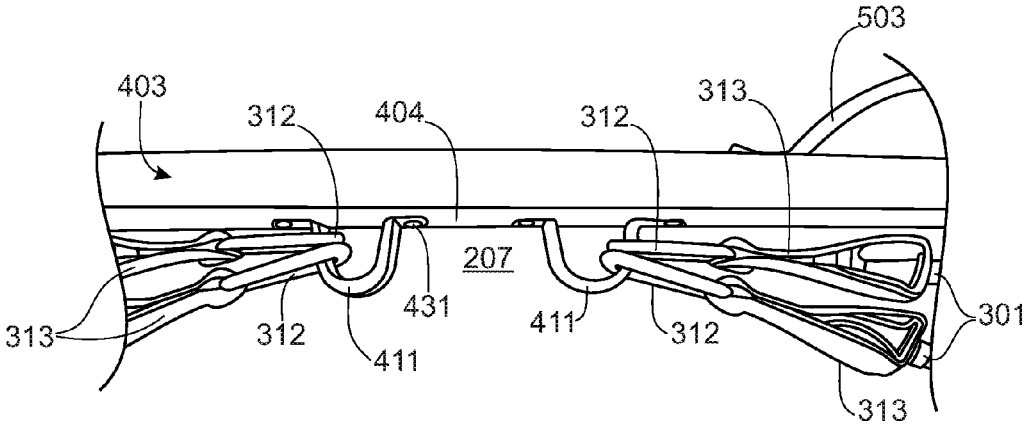
FIG. 4E may depict a partial view of a bottom surface of the rail of the combination table of FIG. 1A, shown from a bottom perspective view.
Figure 4F:
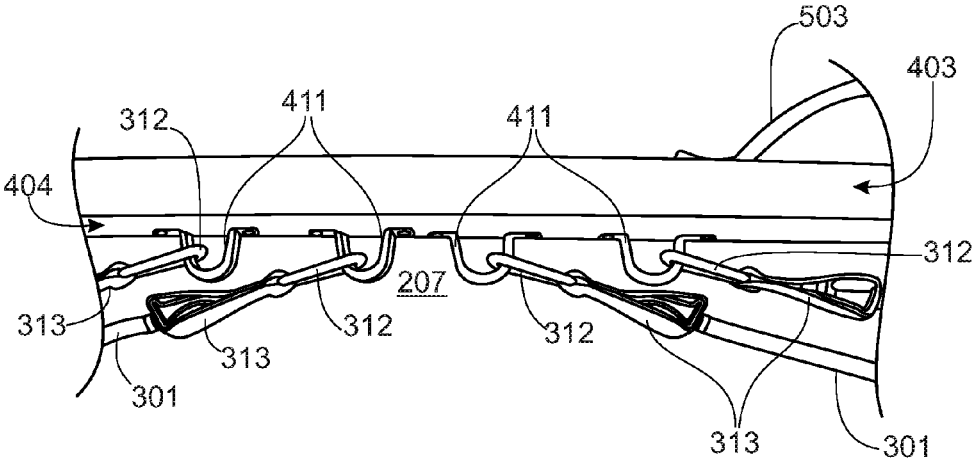
FIG. 4F may depict an alternative embodiment from FIG. 4E, showing a plurality of anchor brackets arranged in a linear serial fashion, shown from the same bottom perspective view of FIG. 4E.
Figure 4G:
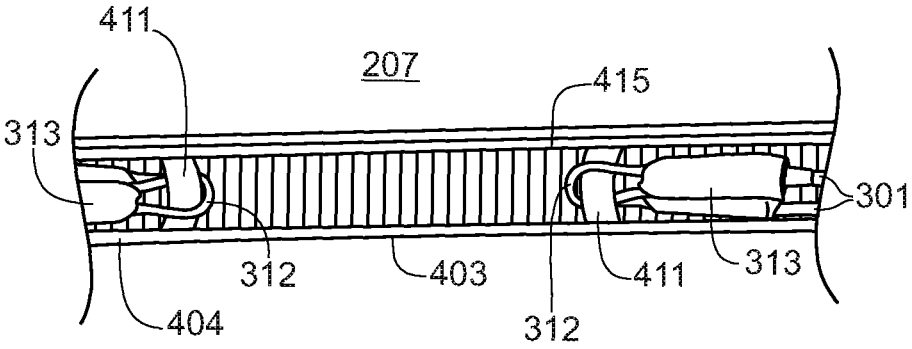
FIG. 4G may depict an alternative embodiment from FIG. 4D, showing a track attached to the interior facing surface of the rail; wherein one or more anchor brackets may be slidingly engaged on this track, shown from the same bottom perspective view of FIG. 4D.
Figure 4H:
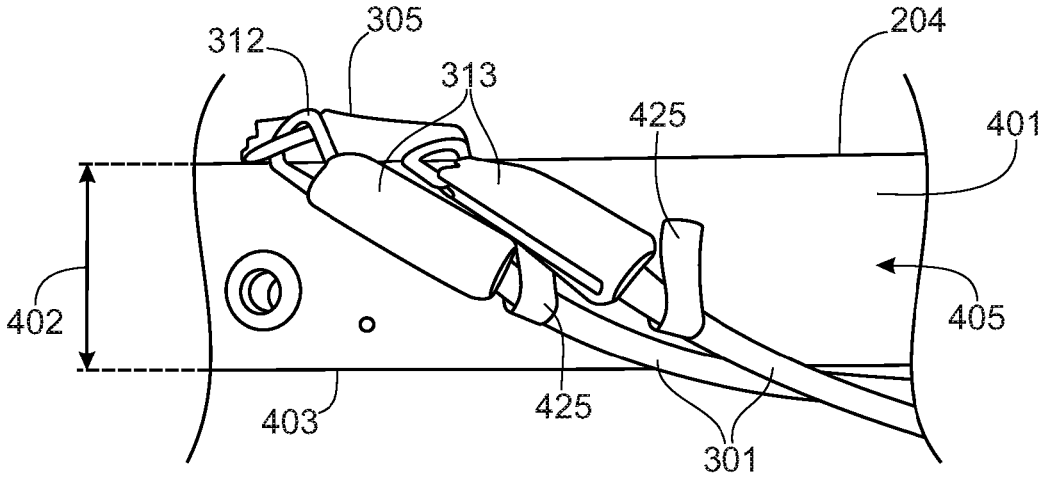
FIG. 4H may depict an alternative embodiment to that of FIG. 4A.

FIG. 4A through and including FIG. 4C may depict band-guides 421; and FIG. 4H may depict a type of band-guide 421, and openable-band-guide 425. While FIG. 4D through and including FIG. 4G may depict anchor brackets 411, as well as the means for attaching one or more resistance bands 301 to massage table 200.

FIG. 4A may depict a partial longitudinal side view of an exterior facing surface 405 of rail 401 of massage table 200. This rail 401 depicted in FIG. 4A, may be from a longitudinal side of massage table 200. FIG. 4A may also depict band-guides 421 mounted to this rail 401 to guide and provide one or more resistance bands 301 at a consistent location for use by client 901. Band-guides 421 depicted in FIG. 4A may be for client 901 upper body use.

Band-guides 421 depicted in FIG. 4B and FIG. 4C may be for client 901 lower body use. FIG. 4B may depict a partial underside perspective view of one bottom corner, a left bottom corner) at foot end 203 of combination table of 100, shown from a bottom perspective view. FIG. 4C may depict a partial view of a same corner as shown in FIG. 4B, at foot end 203 of combination table 100, shown from a transverse width end view. Another opposing bottom corner, i.e., a right bottom corner, may be substantially a mirrored opposite as FIG. 4B and FIG. 4C. FIG. 4B and FIG. 4C may depict portions of rail 401, a rail 401 of foot end 203, i.e., a transverse width rail 401. FIG. 4B and FIG. 4C may also depict band-guides 421 mounted to this rail 401 to guide and provide one or more resistance bands 301 at a consistent location for use by client 901. Before discussing band-guides 421, rails 401 may be discussed.

In some embodiments, massage table 200 may comprise one or more rails 401. In some embodiments, one or more rails 401 may be attached to and/or integral to tabletop 201. In some embodiments, tabletop 201 may be bounded (i.e., circumscribed) by rail 401 that may extend a fixed distance 402 away from bottom surface 207 or that may extend fixed distance 402 away from upper surface 204. See e.g., each of the FIG. 2 figures and see FIG. 4A, FIG. 4B and FIG. 4C.

Or alternatively, in some embodiments, rail 401 may extend downwards from a perimeter of tabletop 201. In some embodiments, rail may extent downwards from lower surface 207; wherein rail 401 emerges from lower surface 207 at some proximate distance from outside edges of tabletop 201. In some embodiments, where tabletop 201 may have a rectangular prism shape, then there may be four rails 401, organized as a pair of opposing longitudinal rails 401 and a pair of opposing transverse width rails 401. See e.g., each of the FIG. 2 figures and see FIG. 4A, FIG. 4B and FIG. 4C.

In some embodiments, rail 401 may extent downward fixed distance 402. In some embodiments, fixed distance 402 may be measured from upper surface 204 (see e.g., FIG. 4A) or from lower surface 207 to some terminal point of rail 402, such as bottom surface 403 (see FIG. 4B) of rail 401. In some embodiments, fixed distance 402 may be from 0.10 inch to 24 inches.

In some embodiments, a given rail 401 may comprise at least three surfaces: bottom surface 403 (see FIG. 4B), interior facing surface 404 (see FIG. 4D), and exterior facing surface 405 (see FIG. 4A). In some embodiments, interior facing surface 404 may be disposed opposite of exterior facing surface 405. In some embodiments, exterior facing surface 405 may face away from massage table 200. In some embodiments, bottom surface 403 may face oppositely away from upper surface 204. In some embodiments, exterior facing surface 405 may be substantially orthogonal to bottom surface 403. In some embodiments, bottom surface 403 may be substantially orthogonal to interior facing surface 404. In some embodiments, bottom surface 403 may face in a substantially same direction as lower surface 207. In some embodiments, exterior facing surface 405 and/or interior facing surface 404 may be substantially perpendicular with bottom surface 403 and/or with lower surface 207. See e.g., FIG. 4B, FIG. 4D, and FIG. 4A.

In some embodiments, a given surface of a given rail 401 such as, bottom surface 403, interior facing surface 404, and/or exterior facing surface 405 may provide anchor surfaces for attaching one or more of: various band-guides 421, anchor brackets 411, and/or tracks 415.

In some embodiments, disposed on exterior facing surface 405 may be one or more of the following: a handle 503 and/or a locking means 504. See e.g., FIG. 5A through and including FIG. 5C. In some embodiments, one or more handles 503 may aid in handling table 100 when in the folded configuration. In some embodiments, one or more locking means 504 may aid in locking the first section 501 to the second section 502 when table 100 may be in the folded configuration. In some embodiments, locking means 504 may comprise one or more of: a clasp, a lock, a key for the lock, a combination for the lock.

In some embodiments, tabletop 201 may be without rails.

In some embodiments, massage table 200 may comprise one or more band-guides 421. See e.g., FIG. 4A, FIG. 4B, and FIG. 4C. In some embodiments, band-guides 421 may be attached to massage table 200 with various mechanical fasteners, such as mechanical fastener 431. In some embodiments, mechanical fastener 431 may be one or more of screws, bolts, and/or rivets. Band-guides 421 may function to keep engagement ends 302 near enough to client 901 hands and/or ankles, such that client 901 hands and/or ankles (without undue effort) may removably engage the engagement structure, such as, but not limited to, handles 305 and/or ankle strap 306.

In some embodiments, each band-guide 421 may comprises circumscribing structure, such as, but not limited to, an eyelet and/or a bracket, that may capture at least some portion of a given one or more resistance band 301, such that the given one or more resistance band 301 may be associated with massage table 200 and accessible to client 901 hands and/or ankles. In some embodiments, this circumscribing structure may permit linear translational sliding of the at least some portion of the given one or more resistance bands 301 that may be captured by the circumscribing structure. See e.g., FIG. 4A, FIG. 4B, and FIG. 4C.

In some embodiments, massage table 200 may comprise at least four band-guides 421, with at least one band-guide 421 for each arm and each leg of client 901. Each band-guide 421 may be attached to massage table 200. In some embodiments, two of the four band-guides 421 may be opposingly attached to massage table 200 on opposing rails 401 of opposing longitudinal sides of tabletop 201 (see e.g., FIG. 4A) or on opposing longitudinal sides of lower surface 207 of tabletop 201; and a remaining two of the four band-guides 421 may be attached to massage table 200 on a same rail 402 of foot end 203 of tabletop 201 (see e.g., FIG. 4B and FIG. 4C) or attached proximate to a same vertical support means of foot end 203.

In some embodiments, half of band-guides 421 may be opposingly attached to different regions of first section 501 providing client 901 hand access to at least one handle 305; while a remaining half of band-guides 421 may be attached to second section 502 providing client 901 ankle access to at least one ankle strap 306.

In some exemplary embodiments, one or more resistance bands 301 may comprise eight resistance bands 301 arranged as follows, with two resistance bands 301 accessible by each arm and with two resistance bands 301 accessible by each leg of client 901 who may be laying on top of tabletop 201 of massage table 200. In some embodiments, each pair (at least two) of resistance bands 301 may be for a given limb (right arm, left arm, right leg, and left leg), may be of different resistances. In some embodiments, massage table 201 may comprise eight band-guides 421, with two band-guides 421 for each arm and with two band-guides 421 for each leg of client 901. In some embodiments, each band-guide 421 may be attached to massage table 200. Each band-guide 421 may comprise circumscribing structure, such as, but not limited to, the eyelet and/or the bracket, that may capture at least some portion of a given one or more resistance band 301, such that the at least some portion of the given one or more resistance band 301 may be maintained in a fixed distance with the massage table 200 and accessible to client 901 hands and/or ankles. In some embodiments, this circumscribing structure may permit linear translational sliding of the at least some portion of the given one or more resistance bands 301 that may be captured by the circumscribing structure. See e.g., FIG. 4A, FIG. 4B, and FIG. 4C.

In some embodiments, two pairs of the eight band-guides 421 may be opposingly attached to the massage table 200 on opposing rails 401 of opposing longitudinal sides of tabletop 201 (see e.g., FIG. 4A) or on opposing longitudinal sides of lower surface 207 of tabletop 201; and a remaining two pairs of the eight band-guides 421 may be attached to massage table 200 on a same rail 401 of foot end 203 of tabletop 200 (see e.g., FIG. 2D, FIG. 4B, and FIG. 4C) or attached proximate to a same vertical support means of foot end 203.

FIG. 4H may depict an alternative embodiment to that of FIG. 4A. In FIG. 4H, the band-guides may be openable-band-guides 425, which may be openable for ease of attaching or detaching the one or more resistance bands 301 at the consistent location for use by the client. In some embodiments, openable-band-guides 425 may be a type of band-guide 421. In some embodiments, any given band-guide 421 may be replaced with openable-band-guide 425. In some embodiments, openable-band-guides 425 may be flexible and/or pliable. In some embodiments, openable-band-guides 425 may be flexible and/or pliable strips of fasteners. In some embodiments, such flexible and/or pliable strips of fasteners may have opposing distal terminal regions comprising the fastening mechanics, such as a Velcro type fastener (e.g., with plurality of hooks and plurality of complimentary receiving loops located on the distal portions of the strips) or a snap type of fastener; wherein these opposing distal terminal regions may be brought together and removably attached to each other via the fastener mechanics which may then form a loop of the strip; wherein this loop may be the circumscribing structure, that may capture some portion of one or more resistance bands 301. In some embodiments, at least one of these opposing distal terminal regions may be attached to exterior facing surface 405, or to any other structure band-guide 421 may be attached to.

As noted, FIG. 4D through and including FIG. 4G may depict anchor brackets 411, as well as the means for attaching one or more resistance bands 301 to massage table 200.

FIG. 4D may depict a partial view of an interior facing surface 404 of a given rail 401 (e.g., a longitudinal side rail 401) of combination table 100, shown from a bottom perspective view. FIG. 4E may depict a partial view of a bottom surface 403 of the given rail 401 of FIG. 4D, shown from a different bottom perspective view. That is, FIG. 4D and FIG. 4E may depict the same structures and same components, but from different viewing angles.

Whereas, FIG. 4F and FIG. 4G may depict different embodiments as compared against FIG. 4D and FIG. 4E. FIG. 4F may depict an alternative embodiment from FIG. 4E, showing a plurality of anchor brackets 411 arranged in a linear serial fashion, shown from the same bottom perspective view of FIG. 4E. FIG. 4G may depict an alternative embodiment from FIG. 4D, showing a track 415 attached to interior facing surface 404 of rail 401; wherein one or more anchor brackets 411 may be slidingly, but lockably, engaged on this track 415, shown from the same bottom perspective view of FIG. 4D.

In some embodiments, for each of one or more resistance bands 301, the means for attaching one or more resistance bands 301 to massage table 200 may comprise one or more of: an anchor bracket 411, track 415 for receiving anchor bracket 411, the various attachment hardware, mechanical fastener 431, and/or anchor end 303. In some embodiments, the various attachment hardware may comprise one or more of: the swivel, the link, the ring, the D-ring, coupling 313, and/or carabiner 312. In some embodiments, for each of one or more resistance bands 301, the means for attaching one or more resistance bands 301 to massage table 200 may comprise one or more of: anchor bracket 411, the swivel, the link, the ring, the D-ring, coupling 313, track 415 for receiving anchor bracket 411, carabiner 312, mechanical fasteners 431, and/or anchor end 303. See e.g., FIG. 3, FIG. 4D, FIG. 4E, FIG. 4F, and FIG. 4G. In some embodiments, links, rings, D-rings, and carabiners 312 may be interchangeable.

In some embodiments, for each pair of one or more resistance bands 301 for association with a given limb of client 901, the means for attaching one or more resistance bands 301 to massage table 200 may comprise one or more of: anchor bracket 411, track 415 for receiving anchor bracket 411, the various attachment hardware, mechanical fastener 431, and/or anchor ends 303. In some embodiments, the various attachment hardware may comprise one or more of: the swivel, the link, the ring, the D-ring, coupling 313, and/or carabiner 312. In some embodiments, for each pair of one or more resistance bands 301 for association with a given limb of client 901, the means for attaching one or more resistance bands 301 to massage table 200 may comprise one or more of: anchor bracket 411, the swivel, the link, the ring, the D-ring, coupling 313, track 415 for receiving anchor bracket 411, carabiner 312, mechanical fasteners 431, and/or anchor end 303. See e.g., FIG. 3, FIG. 4D, FIG. 4E, FIG. 4F, and FIG. 4G. In some embodiments, links, rings, D-rings, and carabiners 312 may be interchangeable.

In some embodiments, a single anchor bracket 411 may have one, two, three, four, or five resistance bands 301 anchored to that given single anchor bracket 411. For example, and without limiting the scope of the present invention, in FIG. 4D and in FIG. 4E, there may be two resistance bands 301 anchored with each depicted anchor bracket 411.

In some embodiments, the means for attaching one or more resistance bands 301 to massage table 200 may permit a given anchor end 303 of each of the one or more resistance bands 301 to be attached to the massage table 200. In some embodiments, the means for attaching one or more resistance bands 301 to massage table 200 may permit a given anchor end 303 of each of the one or more resistance bands 301 to be fixedly associated with particular locations of the massage table 200. In some embodiments, one or more anchor bracket 411 may be attached to the massage table 200. In some embodiments, one or more anchor bracket 411 may be attached to track 415; wherein track 415 may be attached to the massage table 200 and one or more anchor brackets 411 may be received into track 415 (see e.g., FIG. 4G). In some embodiments, carabiner 312, the swivel, the link, the ring, and/or the D-ring may attach to a given anchor bracket 411. Wherein, carabiner 312, the swivel, the link, the ring, and/or the D-ring may also then attach to coupling 313. Wherein, coupling 313 may then attach to anchor end 303 of a given resistance band 301. See e.g., FIG. 4D, FIG. 4E, FIG. 4F, and FIG. 4G.

In some embodiments, for each at least a pair of one or more resistance bands 301, the means for attaching one or more resistance bands 301 to massage table 200 may comprise one of: one or more anchor brackets 411, coupling 313, and carabiner 312. In some embodiments, the means for attaching one or more resistance bands 301 to massage table 200 may permit anchor end 303 of each of one or more resistance bands 301 to be attached to massage table 200; and/or to be fixedly associated with particular locations of massage table 200. In some embodiments, each anchor bracket 411 may be attached to massage table 200. In some embodiments, a given carabiner 312 may attach to each attached (mounted) anchor bracket 411. Each such carabiner 312 may also attach to a given coupling 313. Each such coupling 313 may then attach to a given anchor end 303 of a given resistance band 301. See e.g., FIG. 4D and FIG. 4E.

In some embodiments, each anchor bracket 411, that is not attached to track 415, may attach to a given rail 401 (e.g., interior facing surface 404) of tabletop 201 of massage table 200. See e.g., FIG. 4D, FIG. 4E, and FIG. 4F. In some embodiments, each anchor bracket 411 that is not attached to the track 415, may attach to lower surface 207 of tabletop 201 (this embodiment not depicted in the figures). In some embodiments, each anchor bracket 411 may be attached to massage table 200 with various mechanical fasteners, such as mechanical fastener 431. In some embodiments, mechanical fastener 431 may be one or more of screws, bolts, and/or rivets.

In various embodiments, each anchor bracket 411 may be attached to first section 501, attached to second section 501, or with some anchor brackets 411 attached to first section 501 and some other anchor brackets 411 attached to second section 501. For example, and without limiting the scope of the present invention, in exemplary FIG. 2A, all four anchor brackets 411 may be attached, in pairs, to second section 502, in particular to interior facing surfaces 404 of two opposing rails 401.

Anchor brackets 411 may function to provide an anchor point of attachment for anchor ends 303 of resistance bands 301. In some embodiments, each anchor bracket 411 may comprise at least a partial loop structure, such as an eyelet and/or a bracket that functions as the anchor point for attachment of the various attachment hardware and/or for anchor ends 303 of resistance bands 301. Note, in some embodiments, a given band-guide 421 and a given anchor bracket 411 may be a same hardware component, but used in different ways.

With respect to differences between embodiments depicted in FIG. 4E and in FIG. 4F, in FIG. 4F there may be four anchor brackets depicted, arranged in a linear fashion.

This may provide four slightly different anchor locations for the various resistance bands 301, such that variances in anchor location may vary the resistance of the given resistance band 301 which may be removably attached to a given anchor bracket 411, assuming that the given engagement end 302 remains disposed by a given band-guide 421.

Similarly, in FIG. 4G, anchor locations may be varied by a given anchor bracket 411, that may be slidingly attached to a given track 415, being variable along a longitude of this given track 415. Furthermore, such anchor bracket 411 in the FIG. 4G embodiment may be lockable at the various anchor locations along the longitude of this given track 415. For example, and without limiting the scope of the present invention, opposing ends of such anchor brackets 411 may be squeezed towards each other when anchor bracket 411 may be need to slid along track 415, and once released may frictionally engage track 415 to prevent further sliding translation.

In some embodiments, at least one anchor end 303 may be directly attached to massage table 200, via mechanical fasteners and/or chemical adhesives. In such embodiments, where a given anchor bracket 411 may have been attached to massage table 200, e.g., at a given rail 401 location, anchor end 303 may be directly attached.

Figure 5A:
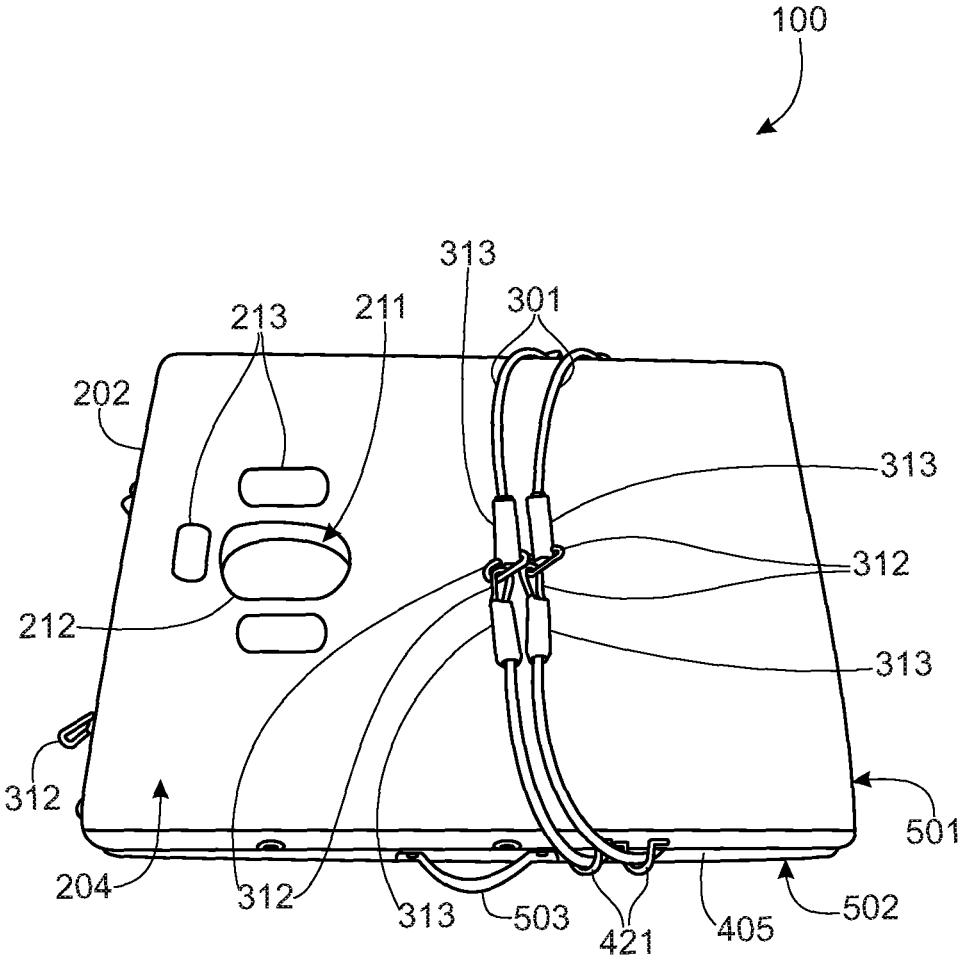
FIG. 5A may depict the combination table of FIG. 1A; wherein the combination table may be in a folded configuration, shown from a top perspective view.
Figure 5B:
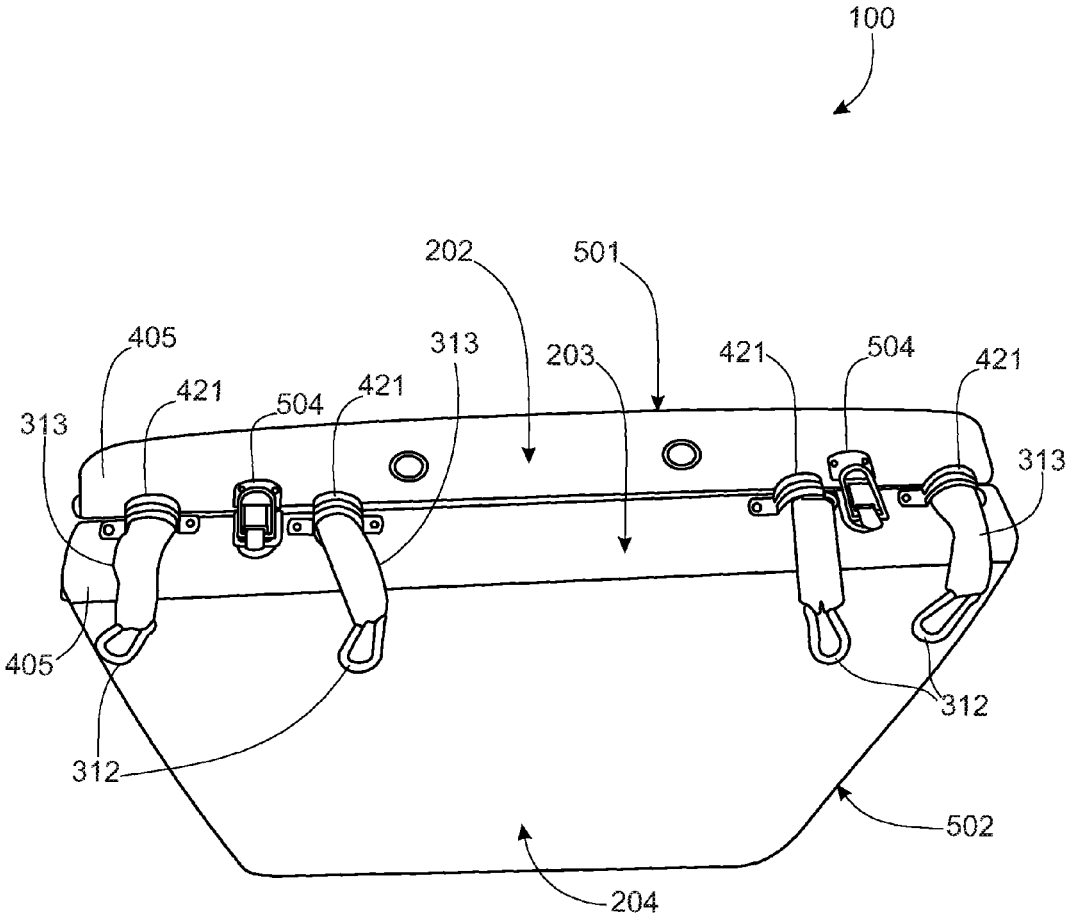
FIG. 5B may depict the same folded configuration of FIG. 5A, but shown from a bottom perspective view while showing a locking means.
Figure 5C:
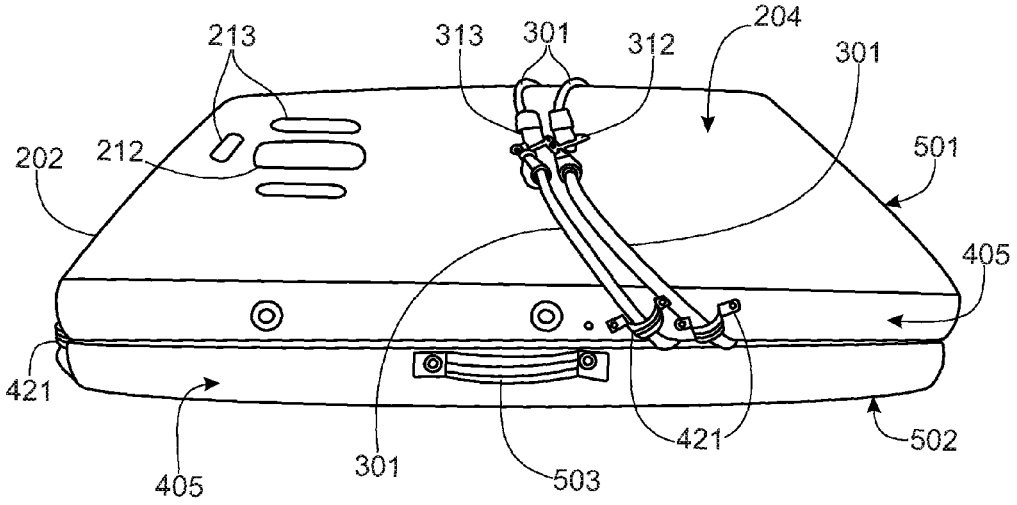
FIG. 5C may depict the same folded configuration of FIG. 5A, but shown from a different top perspective view while showing a handle.

The FIG. 5 series of figures may comprise FIG. 5A through and including FIG. 5C. These FIG. 5 series of figures may focus on depicting the folded configuration of some embodiments of combination table 100. FIG. 5A may depict combination table 100 in the folded configuration, shown from a top perspective view. FIG. 5B may depict the same folded configuration of FIG. 5A, but shown from a bottom perspective view while showing locking means 504. FIG. 5C may depict the same folded configuration of FIG. 5A, but shown from a different top perspective view while showing handle 503.

In some embodiments, tabletop 201 may be foldable along a delineation that may separates tabletop 201 into two sections, first section 501 and second section 502. In some embodiments, first section 501 may be hingedly attached to second section 502 along at least some portion of this delineation. This structure may permit massage table 200 to operate in two configurations, the deployed configuration of the FIG. 1 and the FIG. 2 series of figures and the folded configuration of the FIG. 5 series of figures. In some embodiments, when massage table 200 may be in the deployed configuration, upper surface 204 of both first section 501 and of second section 502 may be substantially sharing a common plane and/or upper surface 204 of both first section 501 and of second section 502 may be substantially collinear; which may be the configuration depicted in the FIG. 1 and the FIG. 2 series of figures.

Whereas, in the folded configuration lower surface 207 of first section 501 may face lower surface 207 of second section 502; which may be the configuration depicted in the FIG. 5 series of figures, although these lower surfaces 207 are not actually depicted in the FIG. 5 series of figures.

In some embodiments, where each of the at least two elongate members (e.g., leg 224) may be attached to tabletop 201, such attachment may be able to pivot between each of the at least two elongate members (e.g., legs 224) and tabletop 201; such that when table 100 may be in the folded configuration, each of the at least two elongate members (e.g., legs 224) may be folded and disposed within first section 501 and second section 502, such that these at least two elongate members (e.g., legs 224) may not be visible in the folded configuration.

In some embodiments, disposed on exterior facing surface 405 may be one or more of the following: handle 503 and/or locking means 504. See e.g., FIG. 5A through and including FIG. 5C. In some embodiments, one or more handles 503 may aid in handling table 100 when in the folded configuration; i.e., handle 503 may be a carrying handle. In some embodiments, one or more locking means 504 may aid in locking first section 501 to second section 502 when table 100 may be in the folded configuration. In some embodiments, locking means 504 may comprise one or more of: a clasp, a lock, a key for the lock, a combination for the lock.

Figure 6A:
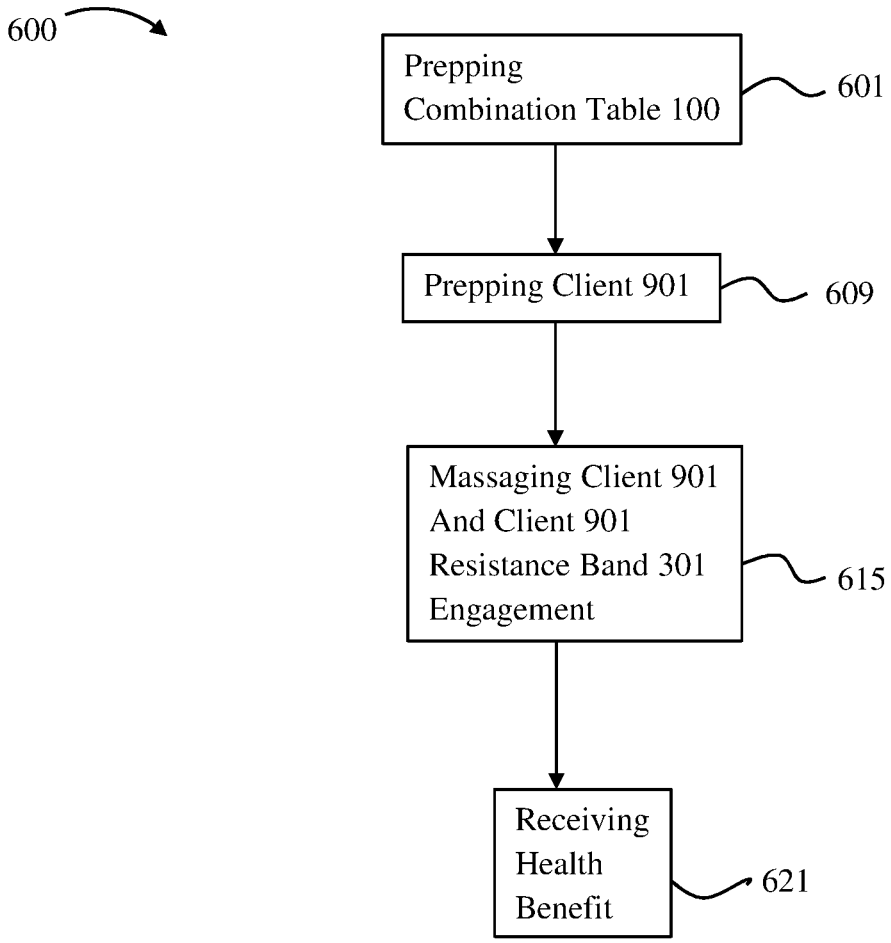
FIG. 6A may depict a method of use of using the combination table of FIG. 1A, shown as a flowchart.
Figure 6B:
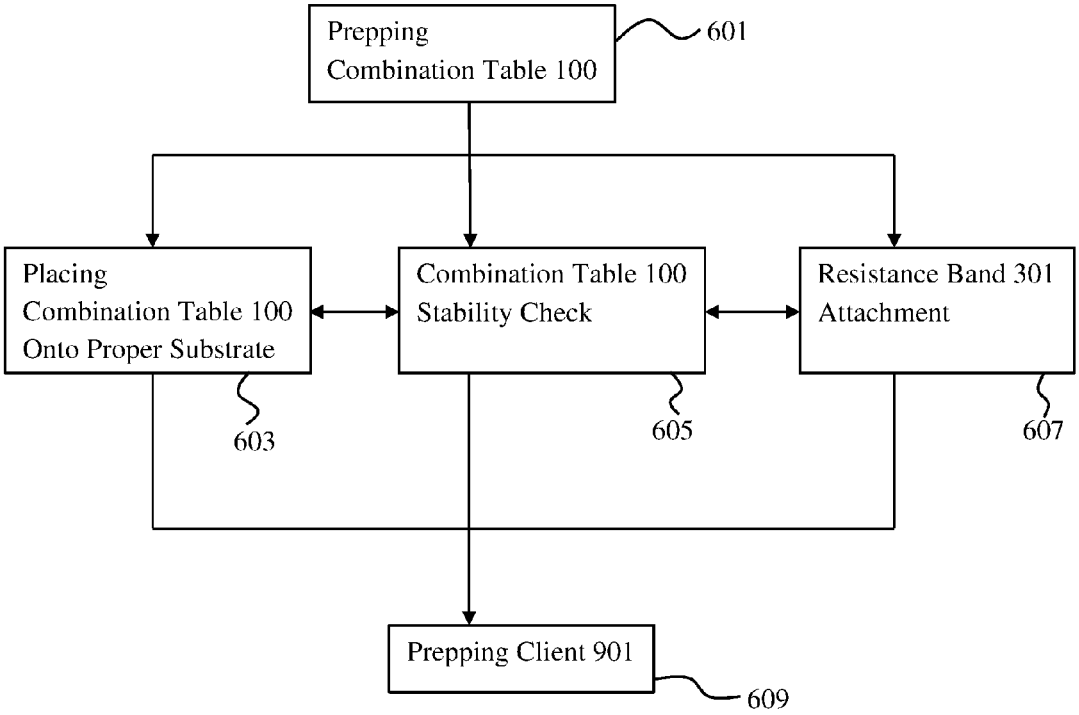
FIG. 6B may depict steps for prepping the combination table, shown as a flowchart.
Figure 6C:
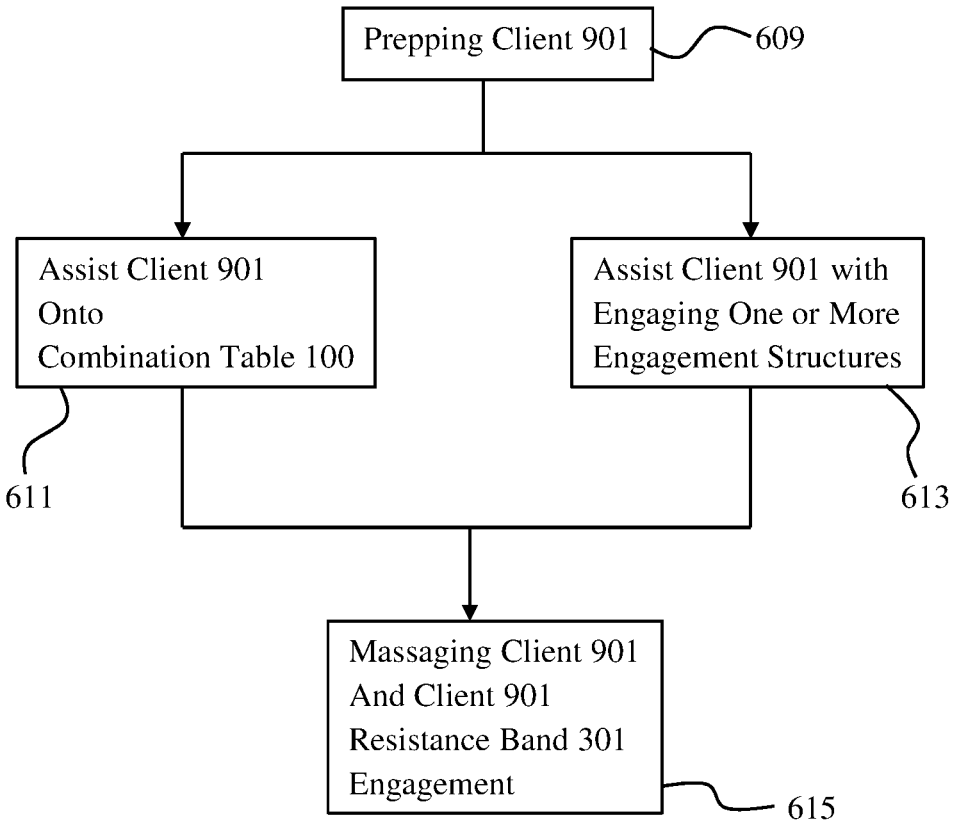
FIG. 6C may depict steps for prepping the client, shown as a flowchart.

The FIG. 6 series of figures may comprise FIG. 6A through and including FIG. 6C. These FIG. 6 series of figures may focus on depicting various method(s) and/or steps involved with using combination table 100. FIG. 6A may depict a method of use 600 of using the combination table 100, shown as a flowchart. In some embodiments, this method 600 may comprise steps of: step 601, step 609, and step 615. In some embodiments, this method 600 may comprise steps of: step 601, step 609, step 615, and step 621. FIG. 6B may depict additional steps (details) of step 601 for prepping the combination table, shown as a flowchart. FIG. 6C may depict additional steps details) of step 609 for prepping the client, shown as a flowchart.

In some embodiments, method 600 may be a method for using combination table 100 to achieve at least one health benefit in client 901. In some embodiments, method 600 may comprise steps of: step 601, step 609, and step 615; and in some embodiments, may further comprise step 621. See e.g., FIG. 6A. In some embodiments, step 601 may comprise preparing combination table 100 for use by client 901. In some embodiments, step 609 may comprise preparing client 901 so client 901 may be lying on top of upper surface 204 of combination table 100. In some embodiments, step 615 may comprise massaging client 901 while client 901 may at least intermittently engage one or more resistance bands 301 that may be attached to combination massage table 100. In some embodiments, step 621 may comprise client 901 receiving at least one health benefit as a result of step 615.

In some embodiments, step 601 of preparing combination table 100 may comprise additional steps as depicted in FIG. 6B. In some embodiments, step 601 may comprise one or more steps of: step 603, step 605, step 607, and/or the like.

In some embodiments, step 603 may comprise placing combination table 100 into the deployed configuration upon a substantially level substrate. In some embodiments, step 603 may comprise placing combination table 100 into the deployed configuration onto a proper substrate, i.e., the substrate that may be substantially level for at least the longitudinal length of combination table 100.

In some embodiments, step 605 may comprise checking combination table 100 for side to side stability and for forwards backwards stability. For example, and without limiting the scope of the present invention, this may entail checking to see if all legs 224 may be properly deployed and in a locked configuration (and at a substantially similar height). If problems with either stability may be found, then step 603 may be re-carried out.

In some embodiments, step 607 may comprise attaching (securing) at least one resistance band 301, selected from the one or more resistance bands 301, to combination table 100, such that at least one resistance band 301 may be anchored at anchor bracket 411 that may be attached to combination table 100. In some embodiments, step 607 may also comprise making sure that at least some portion of at least one resistance band 301 may be captured by a band-guide 421, that may be attached to combination table 100 in a different location from the anchor bracket 411, such that an engagement end 302 of at least one resistance band 301 that may be attached to some of the engagement structure may be accessible to client 901, when client 901 may be laying on top of combination table 100 (e.g., upon upper surface 204). (Recall in some embodiments, anchor end 303 may be directly attached to massage table 200.)

As noted, there may be one or more resistance bands 301 per each limb of client 901 that may be attached to combination table 100. Wherein each pair (two or more) such resistance bands for a given limb of client 901 may have different resistances. Wherein such different resistances may be indicated by different colors of resistance bands 301.

In some embodiments, step 601 of preparing combination table 100 may comprise an additional step of removably attaching head-cushion 214 to at least one head-cushion attachment region 213.

In some embodiments, step 609 of preparing client 901 may comprise additional steps as depicted in FIG. 6C. In some embodiments, step 609 may comprise one or more steps of: step 611 and/or step 613. In some embodiments, step 611 may comprise assisting client 901 with lying on top of upper surface 204. In some embodiments, step 613 may comprise assisting client 901 with engaging one or more of: handle 305 attached to at least one resistance band 301 selected from the one or more resistance bands 301; or ankle strap 306 attached to at least one resistance band 301 selected from the one or more resistance bands 301.

In some embodiments, step 615 may further comprise providing one or more of: oral or visual instructions to client 901 for how to at least intermittently engage one or more resistance bands 301 that may be attached to combination table 100 during a given massage therapy session.

In some embodiments, the at least one health benefit to client 901, that may be received in step 621 as a result of step 615, may be selected from a group comprising one or more of: an increase in relaxation; a decrease in stress; an increase in mobility; an increase in flexibility; a decrease in stiffness; a decrease in pain; improved blood flow; improved blood circulation; reduction of headache quantity; reduction of headache severity; improved rehabilitation; increased client compliance with relevant treatment regiment involving massage therapy that combines resistance band 301 use as compared against massage therapy with no resistance band 301 use; exercising various muscles, resulting in increases in one or more of: strength, calorie burning, and/or muscle toning; and faster achievement of such at least one health benefit as compared to massage without resistance band 301 use.

A combination massage table with one or more resistance bands (i.e., a combination table) has been described. A method using the combination massage table with one or more resistance bands has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A combination massage table with one or more resistance bands comprising:

the one or more resistance bands;

a massage table; wherein the massage table comprises:

a tabletop with an upper surface and a lower surface disposed opposite of the upper surface;

a rail; wherein a perimeter of the tabletop is bounded by the rail that extends a fixed distance away from the upper surface around the perimeter; wherein the rail has three surfaces, an exterior facing surface, an interior facing surface, and a bottom surface; wherein the bottom surface faces substantially away from the upper surface; wherein the exterior facing surface is disposed opposite of the interior facing surface; wherein the bottom surface is substantially orthogonal to both the exterior facing surface and the interior facing surface;

at least four band-guides, with at least one band-guide for each arm and for each leg of a client; wherein each band-guide is attached to the massage table; wherein each band-guide comprises circumscribing structure that captures at least some portion of at least one resistance band selected from the one or more resistance bands, such that the at least one resistance band is associated with the massage table; wherein the circumscribing structure permits linear translational sliding of the at least some portion of the at least one resistance band that is captured by the circumscribing structure; and a means for attaching the one or more resistance bands to the massage table; wherein at least a portion of the means for attaching the one or more resistance bands to the massage table is attached to the interior facing surface; wherein at least a different portion of the means for attaching the one or more resistance bands to the massage table is attached to the one or more resistance bands.

2. The combination massage table with one or more resistance bands according to claim 1, wherein a two dimensional projection of the tabletop as viewed from a top direction is a shape selected from a group consisting of: a rectangle, with or without rounded corners; a regular polygon, with or without rounded corners; an irregular polygon, with or without rounded corners; an oval, an ellipse, and a circle.

3. The combination massage table with one or more resistance bands according to claim 1, wherein the tabletop comprises a face-portal that is formed from a bound cutout within the tabletop that runs from the upper surface to the lower surface; wherein the face-portal comprises an opening that is sized to receive at least some portion of a face of the client such that the client breathes normally when face down upon the upper surface.

4. The combination massage table with one or more resistance bands according to claim 3, wherein disposed around at least some portion of a perimeter of the face-portal and within a proximate distance of the perimeter of the face-portal, is a head-cushion; wherein the head-cushion is a raised cushioned structure that extends away from the upper surface; wherein the head-cushion provides comfort and support to at least some portion of the face.

5. The combination massage table with one or more resistance bands according to claim 1, wherein the massage table comprises a vertical support means that maintains the upper surface at a substantially uniform distance along an entirety of the tabletop with respect to a substrate that the combination massage table with one or more resistance bands is resting upon; wherein the vertical support means comprises at least two opposing elongate members; wherein one end of each of these two opposing elongate members physically contacts the substrate and another oppositely disposed end of each of these two opposing elongate members is attached to the tabletop.

6. The combination massage table with one or more resistance bands according to claim 5, wherein each of the at least two opposing elongate member comprises a pair of legs, such that there are at least two pairs of opposing legs.

7. The combination massage table with one or more resistance bands according to claim 1, wherein each of the one or more resistance bands is an elastic elongate member.

8. The combination massage table with one or more resistance bands according to claim 1, wherein each of the one or more resistance bands comprises two oppositely disposed terminal ends, an engagement end and an anchor end; wherein the anchor end is attached to the massage table via the means for attaching the one or more resistance bands to the massage table; wherein the engagement end is attached to an engagement structure; wherein at least some portion of the engagement structure is engageable by the client who is using the combination massage table with one or more resistance bands.

9. The combination massage table with one or more resistance bands according to claim 8, wherein the engagement structure is selected from a group consisting of one or more of: a handle, a handhold, an ankle strap, a wrist strap, a swivel, a link, a ring, a D-ring, a coupling, and a carabiner.

10. The combination massage table with one or more resistance bands according to claim 1, wherein the one or more resistance bands comprise from one resistance band up to and including twenty distinct resistance bands.

11. The combination massage table with one or more resistance bands according to claim 1, wherein the one or more resistance bands comprises at least four resistance bands arranged as follows, with at least one resistance band accessible by each arm and each leg of the client who is lying on top of the tabletop of the massage table.

12. The combination massage table with one or more resistance bands according to claim 1, wherein two of the at least four band-guides are attached to the massage table on opposing rails of opposing longitudinal sides of the tabletop of the massage table or on opposing longitudinal sides of the lower surface of the tabletop; and a remaining two of the at least four band-guides are attached to the massage table on a same rail of a foot end of the tabletop or attached proximate to the foot end; wherein the opposing rails and the same rail are sections of the rail.

13. The combination massage table with one or more resistance bands according to claim 1, wherein each of the one or more resistance bands is substantially constructed of one or more elastomeric materials.

14. The combination massage table with one or more resistance bands according to claim 1, wherein each of the one or more resistance bands is substantially constructed of one or more of: a natural rubber, a synthetic rubber, a latex rubber, a latex-free rubber, or silicone.

15. The combination massage table with one or more resistance bands according to claim 1, wherein the means for attaching the one or more resistance bands to the massage table comprises one or more of: an anchor bracket, a swivel, a link, a ring, a D-ring, a coupling, a track for receiving the anchor bracket, or a carabiner; wherein the anchor bracket is attached to the massage table on the interior facing surface; or the track is attached to the massage table and the anchor bracket is received into the track; wherein the carabiner, the swivel, the link, the ring, or the D-ring attaches to the anchor bracket; wherein the carabiner, the swivel, the link, the ring, or the D-ring also attaches to the coupling; wherein the coupling attaches to an anchor end of the one or more resistance bands.

16. The combination massage table with one or more resistance bands according to claim 1, wherein when at least a portion of the client is being removably supported by the upper surface and the client is removably engaging a distal portion of the one or more resistance bands at or proximate to an engagement end of the one or more resistance bands, the client receives at least one health benefit.

* * * * *